US011462198B2

(12) United States Patent
Borman

(10) Patent No.: US 11,462,198 B2
(45) **Date of Patent: *Oct. 4, 2022**

(54) DIGITAL MUSICAL INSTRUMENT AND METHOD FOR MAKING THE SAME

(71) Applicant: Christopher E. Borman, Annapolis, MD (US)

(72) Inventor: Christopher E. Borman, Annapolis, MD (US)

( * ) Notice: Subject to any disclaimer, the term of this patent is extended or adjusted under 35 U.S.C. 154(b) by 1053 days.

This patent is subject to a terminal disclaimer.

(21) Appl. No.: 15/804,088

(22) Filed: Nov. 6, 2017

(65) Prior Publication Data

US 2018/0137847 A1 May 17, 2018

Related U.S. Application Data

(63) Continuation of application No. 15/049,543, filed on Feb. 22, 2016, now Pat. No. 9,812,110.

(60) Provisional application No. 62/119,038, filed on Feb. 20, 2015.

(51) Int. Cl.

| | |
|---|---|
| ***G10H 1/34*** | (2006.01) |
| ***G10H 3/12*** | (2006.01) |
| ***G10H 3/14*** | (2006.01) |
| ***G10H 1/00*** | (2006.01) |
| ***G10H 1/055*** | (2006.01) |
| ***G10H 1/057*** | (2006.01) |

(52) U.S. Cl.

CPC ..... *G10H 3/146* (2013.01); *G10H 1/0066* (2013.01); *G10H 1/057* (2013.01); *G10H 1/0558* (2013.01); *G10H 2220/161* (2013.01); *G10H 2220/401* (2013.01); *G10H 2230/275* (2013.01)

(58) Field of Classification Search

CPC ..... G10H 2220/185; G10H 2220/561; G10H 2230/275; G10H 2250/435; G10H 2220/161; G10H 2220/461

USPC ..... 84/603

See application file for complete search history.

(56) References Cited

U.S. PATENT DOCUMENTS

| | | | | |
|---|---|---|---|---|
| 4,852,443 | A | 8/1989 | Duncan et al. | |
| 6,815,602 | B2 | 11/2004 | De Franco | |
| 2011/0167992 | A1 | 7/2011 | Eventoff et al. | |
| 2012/0097009 | A1 | 4/2012 | Eventoff et al. | |
| 2012/0204704 | A1 * | 8/2012 | Shim | G10H 1/0066 84/645 |
| 2013/0340598 | A1 * | 12/2013 | Marquez | G10D 13/02 84/730 |

* cited by examiner

*Primary Examiner* — Christopher Uhlir
(74) *Attorney, Agent, or Firm* — Tollefson IP

(57) ABSTRACT

A new and improved Digital Musical Instrument includes a hardware segment that electronically detects the physical inputs of a musicians musical playing style or articulated intent; a Software segment that interprets and formulates the data output from the hardware segment, to be applied to any digitally modulated synthesizer or recording sampler; and an optional expanded method of sampling or digitally recording articulated sounds of acoustic instruments.

19 Claims, 19 Drawing Sheets

Piezo transducer

Early 1980's designed commercial 'Piezo' drum

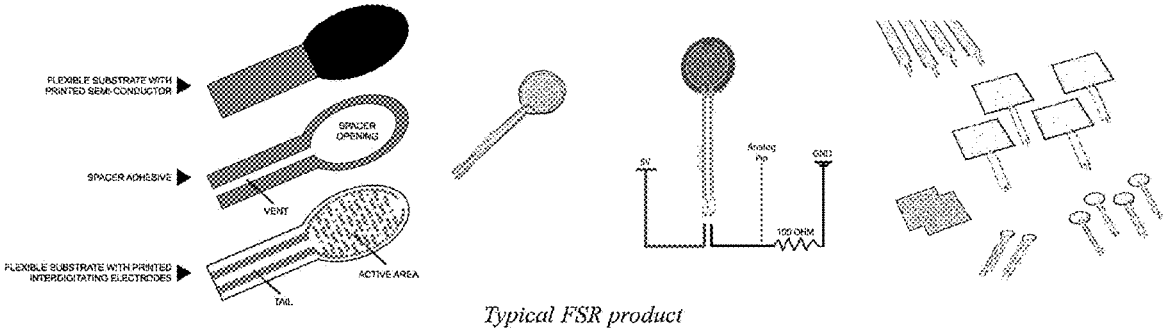
*Typical FSR product*
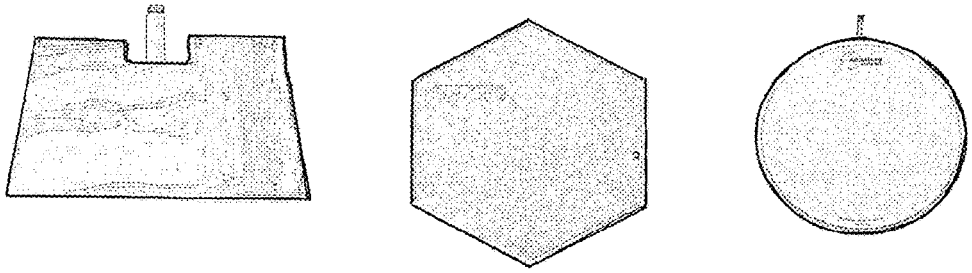
More recent implementations of Flexible *'FSR'* transducers
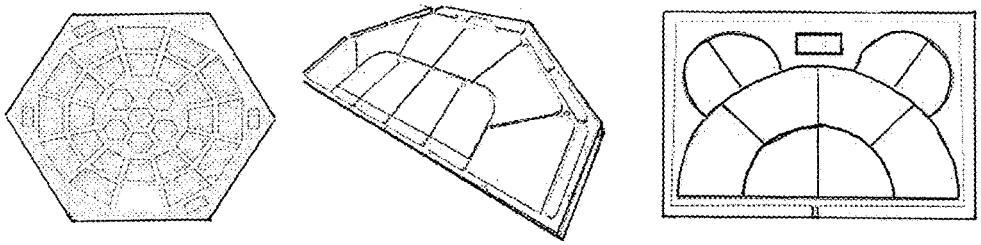
*Various 'Segmented' FSR type pads*
FIG. 3 (Prior Art)

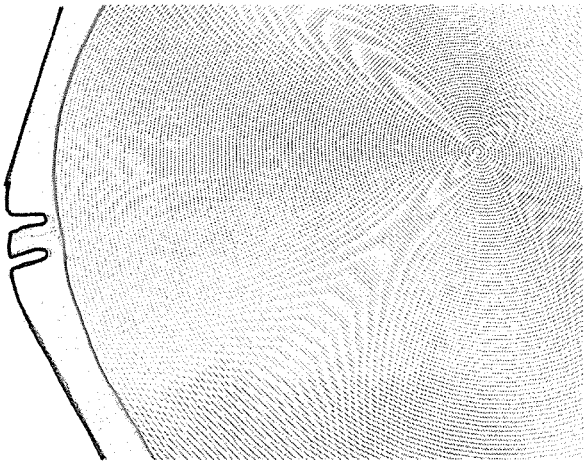
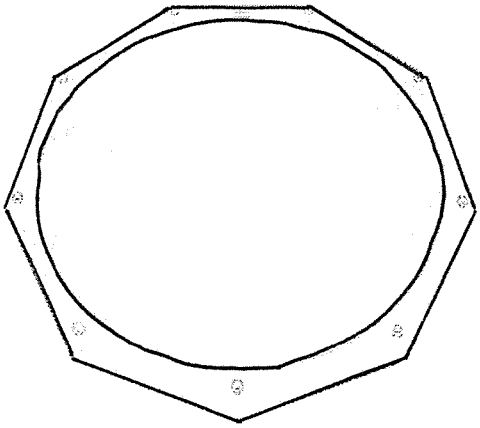
Spiral FSR Center-to-Edge positional sensor
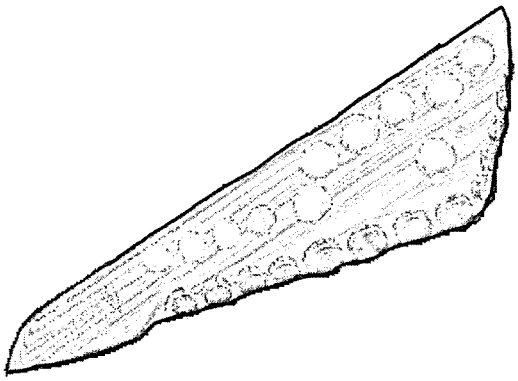
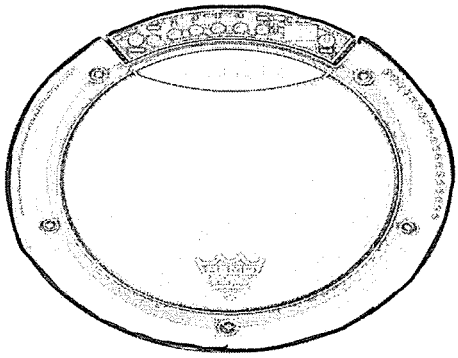
Multi-switched velocity hand trigger
DSP processor model
FIG. 4 (Prior Art)

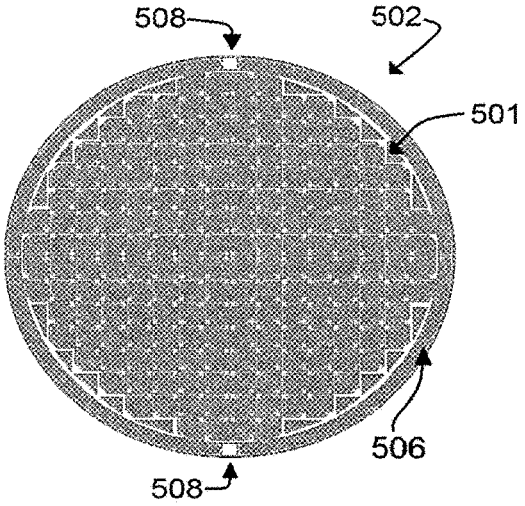
Flexible Mylar Design
Grey = Resistive Print
Blue = Vented Standoff
Yellow = Adhesive
Red = Alignment Holes
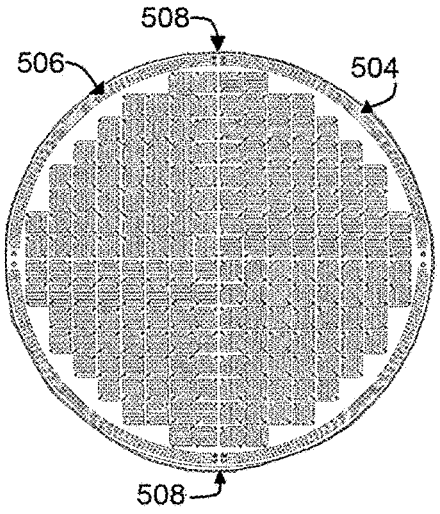
Rigid PCB Mating Surface
Blue = Contact Measuring circuit
Green = Subsurface circuitry contacts/venting
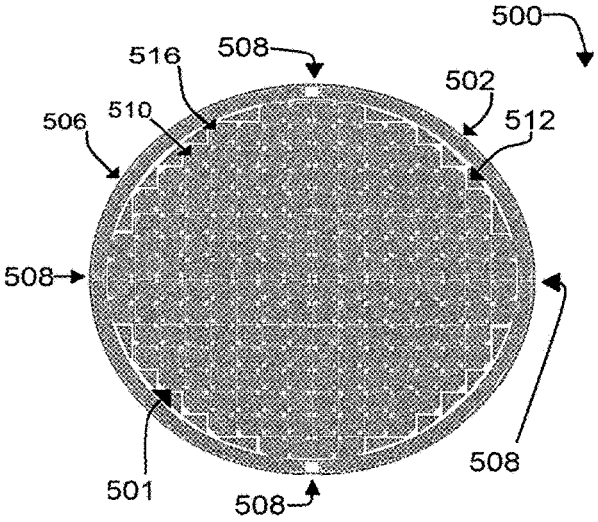
FIG. 5A
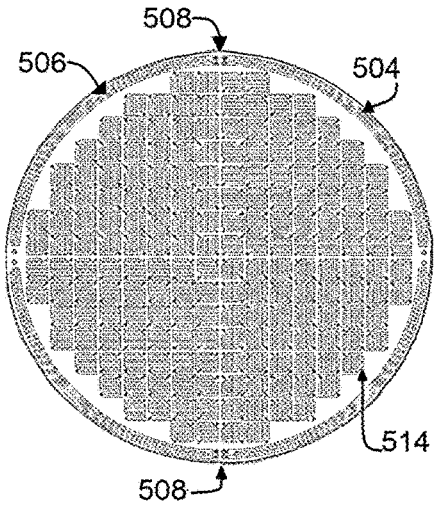
FIG. 5B
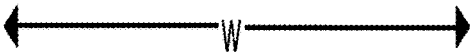

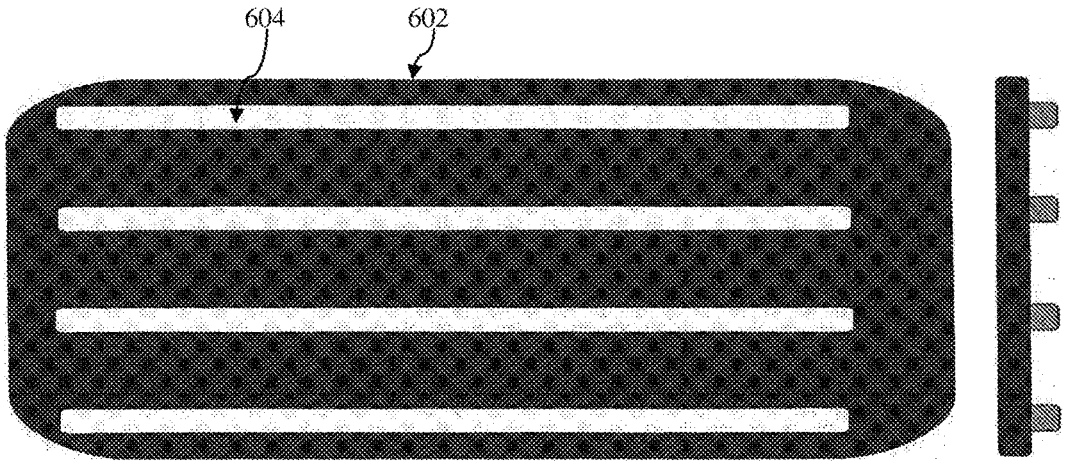
FIG. 6
'String Fretboard' 3D Actuator surface protrusions
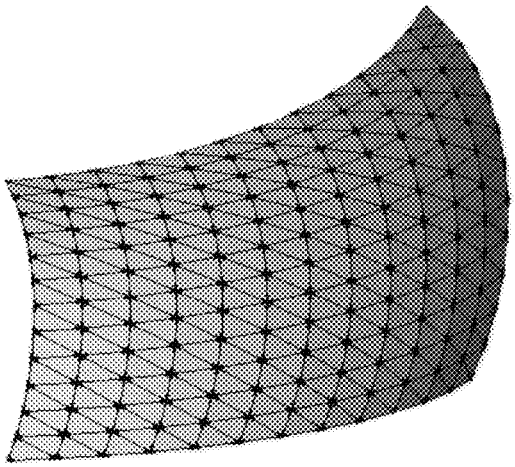
Flexible Sensor
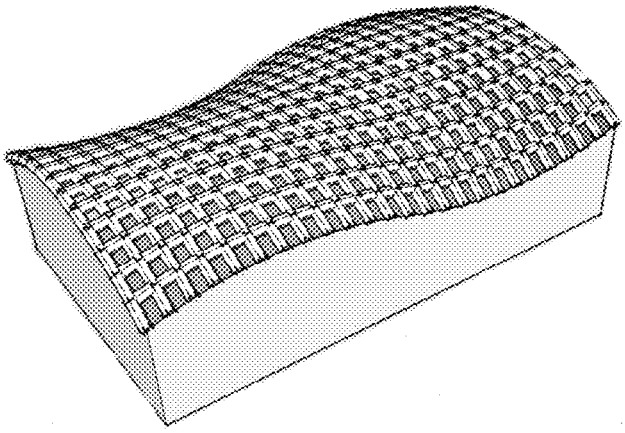
Fixed Base
Complex Curves Surface Impression Transducer designs
FIG.7A FIG.7B

Surface impact damping mechanics

*Singe Pad Cabling*

*Multi Pad DPI Concentrator Cabling*

DIGITAL MUSICAL INSTRUMENT AND METHOD FOR MAKING THE SAME

CROSS-REFERENCE TO RELATED APPLICATIONS

This application is a continuation application of U.S. patent application Ser. No. 15/049,543 filed on Feb. 22, 2016, and which claims priority to U.S. Provisional Application No. 62/119,038 entitled, DIGITAL MUSICAL INSTRUMENT HAVING SURFACE IMPRESSION TRANSDUCER, ATICULATION RECOGNITION PROCESSOR, AND ARTICULATION SAMPLING METHOD, filed on Feb. 20, 2015, the entire contents of which are hereby incorporated by reference.

BACKGROUND FIELD OF THE INVENTION

Field of the Invention

The present invention relates generally to electronic musical instruments and in particular, to new and improved polyphonic digital musical instrument variations that receive articulated input via an improved Surface Impression Transducer for processing via an Articulation Recognition Processor for ultimate modulation of various electronic musical synthesizers and digital recording samplers, preferably implementing the Articulation Sampling Method.

Description of the Related Art

Articulation of acoustic instruments, or how you play them, is what gives the acoustic instrument its depth of sound, sonic coloring and inherent aural uniqueness. This is not always the case with electronic instruments. Successful musical articulation of musical analog/digital synthesizers and digital recording samplers requires full modulation contouring capabilities from the human interface controller, or the sound may be perceived as dry, repetitive and dull.

Electronic keyboards and drum pad controllers constitute the majority of marketable electronic instrument controllers. Electronic keyboards, drum pads and a few specialty controllers offer a generally fixed articulation realm to the musician.

Original monophonic note-on only electronic synthesizer keyboards had limited articulation capability. This was eventually improved with the invention of polyphonic capability allowing one to press multiple keys at a time, for a chord for instance, or individual keys or a range of keys, to generate unique synthesizer sounds or voicings. Keyboard articulation was further enhanced with additional user modulation capability via pitch and modulation wheels, ribbon controllers, key attack and release velocity, key pressure or aftertouch circuits and weighted keys for a traditional or familiar action.

Current electronic drum pad controllers are monophonic in operation and sonically one-dimensional, meaning they process a single impact at a time with force typically being the only processable variable utilized to trigger a sound modulated to a volume level proportional to some arbitrary point along an impact event curve. Most designs are based on piezoelectric transducer technology that generates a voltage proportional to an arbitrary point along the impact event curve. An image of a piezoelectric transducer 202 is shown in in FIG. 2. An image of a commercial "piezo" drum pad 204 is also shown. Piezoelectric transducers suffer from being inherently susceptible to external vibrations, which can cause false triggering. For example, direct mechanical or induced vibration from high power sound reinforcement systems or cross triggering from a strike on one of two adjacent pads literally triggers both. An adjustable voltage limiting circuit could be used to overcome this issue at a cost of reduced sensitivity, further limiting articulation. Piezoelectric designs may also suffer from electro-mechanical response latency causing a discernible delay between the impact event and eventual sound generation, becoming increasingly noticeable during well-articulated or allegro (fast) playing.

Electronic drum pad designs utilizing alternate sensor technologies have been attempted to overcome the limitations of piezoelectric designs through various configurations of piezoelectric transducers, force sensing resistor (FSR) and digital signal processing (DSP) circuits. Some designs incorporate a single action full perimeter rim sensor typically used to trigger snare 'rim-shot' sounds. Even with the microsecond response of the FSR sensor, some designs still experience impact-to-sound latency through incorrect software or hardware implementation.

Key features of the FSR over the piezoelectric transducer include improved latency and reduced susceptibility to false triggering. Some interesting FSR based designs incorporate 2 or 3 separate FSRs, typically arranged in fractional pie form factor utilized to trigger discrete synthesizer voicings but individually include no additional modulation or articulation capabilities.

One interesting design available on the market (U.S. Pat. No. 6,815,602) has its FSR mating circuit arranged in a spiral format to resistively measure impact location in the single center-to-edge vector only along each step of the 127 concentric ring spiral in 11" circular form factor for an approximate fixed 0.087" physical resolution. That design provides a single monophonic center-to-edge vector modulation variable in addition to impact force via piezoelectric transducer. To note, the addition of that single extra modulator allows the musician to create comparatively impressive dynamic sound.

Another FSR based design (U.S. Patent Publication No. 2011/0167992) claims to detect multiple touches. It is described as a multilayer FSR approach; one in spiral format and a second FSR layer in a complex segmented trace configuration format where each segment provides a specific, identifying resistance. The first FSR layer circuitry schematic and layout detail are shown with alternating segments bussed together, the first to provide a singular surface force measurement. The second FSR layer circuitry is shown in a switched multi-tap variable serial/parallel resistor voltage divider network with a multitude of applied resistance shunting and undisclosed 'complex mathematical functions' used to determine touch position. The schematic detail shows electrical configurations for single and dual instances, but configuration of any key detailed circuitry are also not disclosed. The circuitry as shown suggests if more than one actuation were to occur simultaneously along the same network, linear actuation would likely inject an indeterminate resistance into the tapped segment resistance sum, so the expected positional information results would be skewed or indeterminate.

DSP based drum pad sensors perform signal analysis of a transducer's output and have algorithms programmed to attempt to mask or minimize the limitations inherent in component selection or implementation. Sometimes a bit of tom-foolery is incorporated within the microprocessor or DSP algorithm to simulate articulation by applying arbitrary random or pre-determined fixed modulation values. By design, these systems play themselves rather than allow the accomplished musician to actually perform their intent on the instrument.

Another example of a very playable Musical instrument digital interface (MIDI) trigger currently is described in U.S. Pat. No. 5,434,350. An ergonomic array of strategically placed switch activated pressure transducers are mounted in a fine wood finished enclosure. This design presents a multitude of sounds and modulations available at the musician's fingertips. Similar in operation to the accordion, velocity (force) sensitive switches trigger and modulate various notes or sounds and additional switches assignable to modify those sounds similar to the registers of an accordion.

Within 10 years, electronic keyboard modulation capability vastly improved as did customer satisfaction as well as the resulting increase in sales. However, in the case of electronic drum pads, few articulation improvements have been made at all. The electronic drum pad has been around for 30+ years with virtually no change in modulation capability. Major product enhancements have only been shell cosmetic and surface configuration to mimic acoustic drum look and feel. FIG. 1 shows an adjustable head tension mechanism 102 and a physical aesthetic emulation of acoustic drums 104.

Thus, there is a need for new and improved digital musical instruments that advances over the state of the art. While a variety of MIDI controller designs exist, there is a need for fresh approach to improved polyphonic digital music instruments architecture and methods with making the same.

The present invention addresses this and the objectives by providing new and improved polyphonic digital musical instrument that receives input via an improved Surface Impression Transducer and Articulation Recognition Processor, preferably used in conjunction with the Articulation Sampling Method, to address the limitations of and to advance the stat of the art.

SUMMARY OF THE INVENTION

According to embodiments of the present invention, a digital musical instrument is provided that includes plurality of sensors and a sampling circuit for processing an impact event when one or more of the sensors are impacted. A processor maps the impact event to one or more sounds based on the sampled impact event and outputs the sound.

According to embodiments of the present invention, a digital musical instrument provides a fully software reconfigurable means of making electronically articulated musical sound in methods very similar to acoustic musical instruments.

According to embodiments of the present invention, a digital musical instrument may be comprised of three segments:

1. Surface Impression Transducer—the segment that electronically detects the physical inputs of a musician's musical playing style or articulated intent;
2. Articulation Recognition Processor—the segment that interprets and formulates the data output from the Surface Impression Transducer to be applied to any digitally modulated synthesizer or recording sampler; and
3. Articulation Sampling Method—an optional expanded method of sampling or digitally recording articulated sounds of acoustic instruments.

Various implementations of the Digital Musical Instrument incorporating the Surface Impression Transducer and Articulation Recognition Processor segments provide expanded dynamic articulation, giving an expanded sound palate, giving the musician the ultimate capability to articulate digitally modulated synthesizers and recording samplers in methods very similar to acoustic musical instruments.

Incorporating the optional Articulation Sampling Method segment further augments the electronic articulation possibilities that only the digital musical instrument can fully exploit.

According to embodiments of the present invention, an instrument design integrating the segments of the digital musical instrument could be used to trigger sounds within full control by a musician that truly reflect the dynamic articulation the musician demands. Existing or improved synthesized or digitally sampled acoustic instruments using the Articulated Sampling Method as well as the capability to substitute and modify articulations, for example applying the articulations or modulations of a Trombone to a Steel Drum sound and vice versa, or to create an entirely new set of physical articulate actions similar to how a music synthesizer is used to emulate existing sounds, or create entirely new sounds.

The digital musical instrument segments may include an improved Surface Impression Transducer, Articulation Recognition Processor and Articulation Sampling Method, implemented in musical instrument designs to provide the musician the ability of fully articulated polyphonic impact and pressure events control of audio musical digital synthesizers/samplers sonically reflecting the intended articulations.

According to embodiments of the present invention, the Surface Impression Transducer engineering designable form factor options and sensor density can match a target instruments physical playability. 3D Complex Curve shaping possibilities of the Surface Impression Transducer further enhance form factor engineering design possibilities for playability.

According to embodiments of the present invention, the Articulation Recognition Processor software algorithms in musical instrument design applications implemented in generality can be the same for chromatic, percussive or other musical instruments. User configuration of where and how a musicians applied impact and pressure events are interpreted, what sounds are triggered and the appropriate and/or desired modulation contouring uniquely define how impact or pressure events are interpreted and what and how sounds are modulated. For clarity, alteration of a sound is considered modulation, and the present invention can be applied to volume, pitch, ADSR, etc.

According to embodiments of the present invention, the Articulation Sampling Method utilized within an appropriate digital synthesizer sampler will provide the musician an entirely brand new expanded realm of applicable modulation articulate contouring capabilities and possibilities of generating sounds. In effect, an advanced method of making music.

According to an embodiment of the present invention, a replaceable transducer surface surround may be provided that has durable molded in markings, lines, colors or aesthetics, which can provide a durable user guide of the surface configuration and enhance user satisfaction. The replaceable surface offers a method to adjust surface thickness, durometer, gloss or other physical properties comprising 3D protrusions or depressions that enhance articulation capability, desired articulation feel, rebound, durability or other preferential reasons.

According to an embodiment of the present invention, a replaceable surface comprising a molded in surface configuration user guide. Examples include a molded surface resembling a tuned steel drum or other representative image for use with specific configurations or general use.

To support varying sensitivity versus durability or other requirements. Scenarios may include heavy marching sticks versus light jazz sticks, brush work, hand drumming, various finger or other actuation methods. User aesthetics could include color schemes, custom molded in design or other desired aesthetic embellishments.

According to embodiments of the present invention, a Digital Musical Instrument using an Articulated Sampling Method having capability to substitute and modify articulations, such as applying the articulations or modulations of a Trombone to a Steel Drum sound and vice versa, or to create an entirely new set of physical articulate actions similar to how a music synthesizer is used to emulate existing sounds, or create entirely new sounds.

According to embodiments of the present invention, a Digital Musical Instrument includes an improved Surface Impression Transducer, and an Articulation Recognition Processor coupled with said transducer and configured to execute an Articulation Sampling Method to provide a musician the ability of fully articulated polyphonic impact and pressure events control of audio musical digital synthesizers/samplers sonically reflecting the intended articulations.

According to embodiments of the present invention, the Surface Impression Transducer is engineering designable form factor options and sensor density can match a target instruments physical playability; and wherein 3D Complex Curve shaping possibilities of the Surface Impression Transducer further enhance form factor engineering design possibilities for playability.

According to embodiments of the present invention, the Articulation Recognition Processor software algorithms in musical instrument design applications implemented in generality are the same for chromatic, percussive or other musical instruments; and wherein User configuration of where and how a musicians applied impact and pressure events are interpreted, what sounds are triggered and the appropriate and/or desired modulation contouring uniquely define how impact or pressure events are interpreted and what and how sounds are modulated.

According to embodiments of the present invention, the Articulation Sampling Method is utilized within an appropriate digital synthesizer sampler to provide the musician an entirely brand new expanded realm of applicable modulation articulate contouring capabilities and possibilities of generating sounds.

The present invention is ideally suitable for, but not limited to, percussive and chromatic mallet keyboard instrument designs. The present invention can be configured to recognize similar articulations used in chromatic stringed fret board playing in a similar form factor design, and is especially suitable for new ergonomic and articulable designs.

According to embodiments of the present invention, the digital instrument may be configured to recognize various impact, pressure and movement events. Multiple events can occur simultaneously, in any area on the Surface Impression Transducer surface as well as different areas can be programmed to respond uniquely. The impact and pressure events can be enhanced or modified by various simple mathematical functions and mapped to any MIDI command or synthesizer function including note triggering, any sound bank available, pitch, volume and any available modulation or other sound control provided over the MIDI channel. These physical articulation events include, but are not limited to:

- x,y (and/or z) location
- Area, wholly or segmented.
- Shape
- Force
- recurring Rate
- Full control of dynamic physical ADSR envelope tracking
- Sharp taps—quick attack
- Dull presses—slow attack
- various directions of slides
- muting—Various pressure area applied simultaneous with impacts.

The impact and pressure events can be enhanced or modified by various simple mathematical functions and mapped to any MIDI command or synthesizer function including note triggering, pitch, volume and various modulations or other sound control available. Further applications and advantages of various embodiments of the present invention are discussed below with reference to the drawing figures.

BRIEF DESCRIPTION OF THE DRAWINGS

FIG. 3 illustrates prior art FSR products, recent implementations of Flexible 'FSR' transducers, and existing segmented FSR pads.

FIG. 4 illustrates prior art spiral FSR center-to-edge positional sensors, a multi-switched velocity hand trigger, and a DSP processor model.

FIG. 5A illustrates an embodiment of the invention having a flexible Mylar design.

FIG. 5B illustrates an embodiment of the invention having a Rigid PRINTED CIRCUIT mating surface.

FIG. 6 illustrates an embodiment of the invention having a 3D actuated Stringed Fretboard.

FIG. 7A illustrates an embodiment of the invention having a 3D Floating Surface with Base.

FIG. 7B illustrates an embodiment of the invention having a 3D Fixed Surface.

DETAILED DESCRIPTION OF THE PREFERRED EMBODIMENTS

Figure 1:
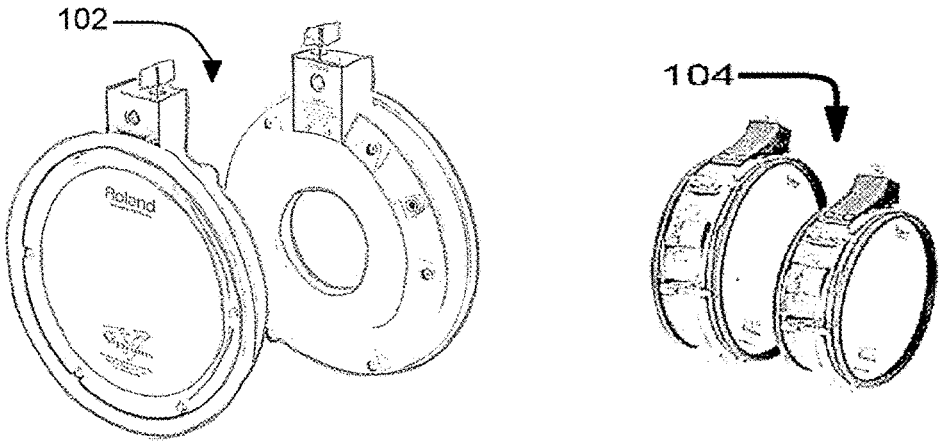
FIG. 1 (Prior Art)
FIG. 1 illustrates prior art advancements in head material and cosmetics.
Figure 2:
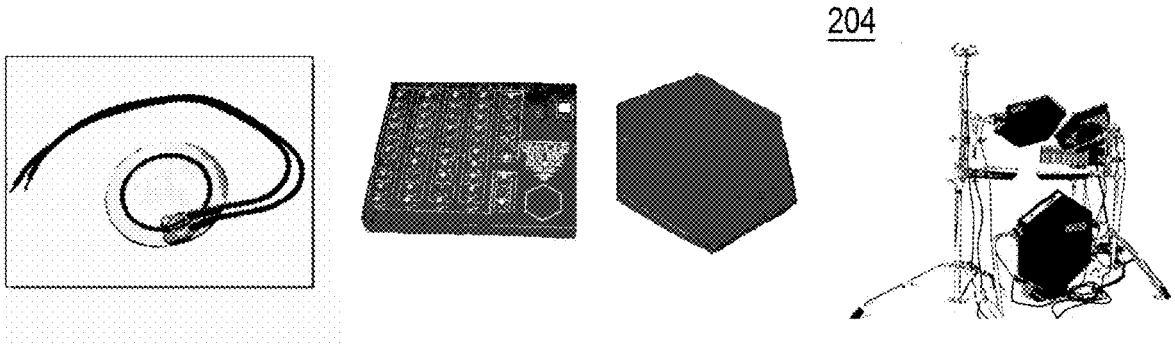
FIG. 2 illustrates prior art piezoelectric transducer, early 1980's designed commercial 'Piezo' drum, and a fully autonomous vintage 'speaker coil' transducer/synthesizer.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

The present invention can provide an order of magnitude improvement over today's electronic musical instruments such as electronic musical instrument controllers, electronic keyboards, electronic drum pads and digital sampling methods and is the first and only digital electronic musical instrument architecture on the market today that provides an overall improvement in real-time electronic musical articulation control by providing among other features a fully programmable and re-configurable fully polyphonic Surface Impression Transducer surface and Articulation Recognition Processor software algorithms. The example given herein of a Digital Percussion Instrument application provides a glimpse into the power of the invention. A truly brand new and unique state of the art first Digital Musical Instrument in and of itself that stands alone providing the accomplished musician for the first time, a new found freedom of expression with fully programmable articulatable modulation of the unlimited and infinitely variable sound palate and modulation contouring capabilities of audio music synthesizers and real-world digital audio samplers that operate via the Musical Instrument Digital Interface (MIDI) specification or other protocols.

Key ingredients that make this concept such an attainable and marketable reality include the integrated mix of low cost composite sensor design. Analog data multiplexing and digital conversion circuits. Hi-performance microprocessors with supporting software and the availability of powerful computer platforms.

At the core of the present invention is an improved Surface Impression Transducer which can be dimensioned into 2D and 3D surface depression/protrusion area form factors and sensor densities with analog or digital data output schemes to suite various integration requirements. An application embodiment of the Surface Impression Transducer of the present invention may comprise an individual output arrangement providing a physical sensor density factor of impact or pressure event granularity from approximately one to an ⅛ inch, as implemented in the digital percussion instrument drum pad controller application, or other application's specific implementation requirements.

The improved Surface Impression Transducer hardware emits a sensor density factor multiplicity of two variables; dynamic impact or pressure event position granularity, and linear force.

Supporting interface hardware may require a multiplexed analog interface with I-V conversion, analog-to-digital conversion and sufficiently powered integrated processors with real-time operating software algorithms based on the Articulation Recognition Processor to extract impact event force and position and compute additional useful impact characteristics as described in this document.

According to the embodiment of the present invention, the Surface Impression Transducer is constructed using an improved composite form of flexible Force Sensing Resistor (FSR) type design elements integrated onto rigid Printed Circuit Surface Mount Technology (SMT) arranged into an arbitrary edge-to-edge full surface x,y array of sensors. In one example, the SMT's are arranged in an arbitrary array and the sensors are individually elongated hexagonal shaped.

By incorporating flexible printed circuit board technology, complex curved dimensional designs form factors can be accomplished. See FIGS. 7A-7B.

Referring to FIGS. 5A and B, each individual sensor 500 includes a durable, flexible overlay substrate 502 (e.g., Mylar) with an applied resistive print 501 that electrically shorts against an opposed mating, similarly shaped rigid printed circuit 504 functioning to apply both a voltage and present the quantity of resistive print contact via a single measurement tap. The flexible substrate 502 allows for gradual, linear increase in current flow as the effective shorted area of the resistive print increases against the mating rigid circuit 504 at the rate of increased applied pressure.

Also printed on the substrates 502 and 504 is a spacer 506 that fully surrounds the resistive print that with the rigidity of the substrate itself, helps suspend the resistive print just above the rigid circuit in a static zero linear resistive contact or off state. Within the enclosed spacer surround, venting areas 508 can be provided on either short side which corresponds to open via/venting placement on the printed circuit 504. This venting arrangement allows the flexible substrate 502 resistive print floating 'bubble' to be physically linearly forced down onto the mating circuitry 504 electrically shorting the circuit thereby initiating current flow. The flexible substrate 502 may be sensitive to light impact or pressure actuation, and the matrix format of the full surround spacer has the added benefit of increased overall standoff durability of the substrate in heavy or aggressive impact scenarios. The substrate 502 gradually returns to its static or off state at the rate force is removed until eventually turning off all current flow. This composite arrangement effectively functions as a Switched Area Rheostat (SAR).

Referring to FIG. 6, an improved Surface Impression Transducer design may comprise a modified version of the SAR 602 which is elongated sensor 604 incorporating an alternate power routing scheme. These sensors function in a similar fashion to the SAR 500, but the application of voltage may be electrically switched directly onto the Mylar resistive print for one example.

A key function in this switching arrangement allows for a dual mode sensor to function as both a Switched Area Rheostat and Positional Potentiometer (SARP) measuring impact force in SAR mode and impact position about the super elongated dimension of the sensor in SARP mode. In SARP mode, the voltage to the mating printed circuit can be switched off, then a voltage can be applied directly to the Mylar resistive print through a special contact on the printed circuit. This allows for voltage to flow through the resistive print then onto the mating the printed circuit at the forced contact point, with increasing resistance as contact is made further from the mating circuit point. This allows for positional measurement as force is applied at various positions about the elongated dimension.

SARP mode effectively functions as a linear positional potentiometer or durable ribbon controller type device that could be implemented as a 'string' in a stringed instrument type musical controller design application. The alternate power connection to the SARP can be accomplished by a switched transistor voltage circuit thru a buildup of anisotropic bonded adhesive film placed between a designated end area of the SARP Mylar resistive print and mating printed circuit. Mylar resistive print 'bubble' venting can be accomplished through printed circuit vias 516 shown on both sides of each sensor circuit 510 on the elongated ends of the sensor.

With reference to FIGS. 5A and 5B, some additional unique features of the improved Surface Impression Transducer comprise small areas of adhesive used to secure the flexible overlay to the printed circuit during sensor assembly and holes 512 placed about the overlay to mate to printed circuit alignment pins 514 that fix the registration of the resistive print to the mating printed circuit assembly.

The durable Mylar overlay is a flexible force induced progressive linear area resistive contact offers a variety of advantages; including extreme durability vs. sensitivity options; good repetitive impact return durability; fast return static off state; full standoff matrix enhances reliable return life; and Mylar substrate registration holes fix sensor alignment.

The printed circuit provides highly durable circuit substrate and effective support, and pretreating includes fine pitch beveled printed circuit for improved sensor durability; hi-reliability supply and output connections; venting scheme allows full edge-to-edge sensor surface; and printed circuit registration pins fix sensor overlay alignment.

The present invention outperforms, solves and improves upon existing Piezo, FSR or DSP transducer technologies by including full Edge-to-Edge surface impact and pressure detection; sensor density from 1 to approximately overall dimension/8 $mm^2$; and Fully Programmable Monophonic or Polyphonic articulatable chromatic percussive surface.

How one plays, or articulates, an instrument to vary its sound, is an important characteristic that the professional musician exploits to produce an instrument's unique tonal coloring resulting in that performer's instantly recognizable sound. Today's musical instruments are essentially fixed in nature as far as articulation with the exception of some electronic instruments and the resulting fundamental sounds. As described below, the present invention provides the musician dynamically articulable performance capability far beyond any existing acoustic musical instruments or electronic musical controllers.

Musical instrument designs integrating the Surface Impression Transducer of the present invention, in the desired form factor, can provide true user configurable actuated articulable response characteristics through an Articulation Recognition Processor algorithm comprising percussive or chromatic articulated event recognition of any such applied dynamic technique.

Configurable Software or firmware maybe provided to respond to desired changes in physical percussive or chromatic mapping, musical articulation and dynamics, in order to provide true user controlled response to any such applied articulated event. For instance, the invention can be configured to respond to physical area articulations comprising taps, slides, bends, mutes or other movements of various dynamic percussive and chromatic actions. Existing accessories such as String, Breath, Foot Pedal or other controllers for example can be fully mapped into and integrated within the invention as alternate articulate devices to further augment or complement the inventions potential.

According to embodiments of the invention, a key component of the invention's improved functionality integrated within the Articulation Recognition Processor software architecture is Timekeeping.

True velocity can modulate throughout the duration of impact or pressure events. Electronic keyboards correctly sum attack and release velocity times, but do not capture velocity modulations throughout the event. Electronic Drum Pad technologies today capture a single arbitrary point along the evolving event curve.

According to the present invention, each impact or pressure event across the sensor array may be dynamically multi-sampled by high speed computer processor. This allows the processor to capture the entire impact event, over time, from initial impact through its peak and eventual drop off, including residual modulating pressures, or positional changes, occurring throughout the event with performance beyond a simple attack-decay-sustain-release (ADSR) like function. Referred to as the Envelope of a sound. Generally fixed on acoustic instruments where a musician's dynamic articulation can modulate or vary the envelope changing the instruments sound to some extent in defining their own unique sound. A configurable setting on synthesizers used to emulate acoustic instruments can be modulated by various means. The present invention blends the distinction between acoustic and electronic instruments giving the musician full real-time dynamic articulation control of ADSR and hence the instrument. As previously mentioned, Existing drum pads essentially only trigger a sound to a volume level proportional to force. Keyboards trigger sounds statically upon a key press, modulated (articulated) by attack/release velocity, and dynamically by after-touch key pressure or other physical modulation controls.

This inventive software algorithm allows computation of true impact velocity curves, modulating pressures, positional movements, area or other articulated events. According to embodiments of the present invention, the algorithm may be configured to recognize various impact, pressure and movement events. Multiple events can occur simultaneously, in any area on the Surface Impression Transducer surface as well as different areas can be programmed to respond uniquely. The impact and pressure events can be enhanced or modified by various simple mathematical functions and mapped to any MIDI command or synthesizer function including note triggering, any sound bank available, pitch, volume and any available modulation or other sound control provided over the MIDI channel. These physical articulation events may include, but are not limited to:

x,y and/or z location
Area, wholly or segmented.
Shape
Force
recurring Rate
Full control of dynamic physical ADSR envelope tracking
Sharp taps—quick attack
Dull presses—slow attack
various directions of slides
muting—Various pressure area applied simultaneous with impacts.

As a result, capabilities can include the full scope of articulated events comprising taps, plucks, modulating pressures, area variances, slides, rolling or other physical actions of the musicians performance that truly recognize dynamic articulations being ultimately applied to the resulting sound intent.

An exemplary prototype 6" drum pad application may include a Surface Impressions Transducer 500 that is 16 physical sensors 510 wide. To exploit the range of possible MIDI variables, the surface may provide up to 128 variable positions. With a rough granularity of two adjacent sensors 510 impacted simultaneously with similar force within a given time-frame, can determine that impact occurred right between adjacent sensors. Similar impact timing, but a little more force to one of the adjacent sensors, the impact point may be judged to have moved towards the sensor with the higher force. This can work concurrently in both the x and y axis.

When impact or pressure events occur over a multitude of adjacent sensors, similar algorithms can be provided to determine the 'area' of impact or pressure events. The resulting software impact timing, force analysis and adjacency may be used to expand or modify the net density of a physical sensor array or compute impact area.

Below are further descriptions of the Articulation Recognition Processor MIDI Impact Translation (MIT) algorithms utilized in the Digital Percussion Instrument application.

To exploit or produce the modulation capabilities of a digital musical instrument application, an improved method of digital sampling or synthesis could be implemented to build a sufficiently populated dynamically articulatable improved sound database. Preferably, the sound database is not just the one dimensional sound itself, singularly or multi-sampled throughout a frequency range, but a multidimensional record of synthesized or acoustic instruments dynamic articulatable sounds.

One will appreciate that the database could include samples of particular musician's articulations of instruments, as in base instruments' ADSRs. Sampled strike events could be mapped to desired percussion or musical notes, for example, played by the user's favorite musician. For example, a drummer using the present invention could play the drums and sound just like John Bohnam or Keith Moon.

Moreover, by analyzing a strike event over time, the present invention can be configured to discriminate between strike events having even milliseconds of different. That is, if a user playing the present invention were to leaves a drum stick on the DPI for 5 milliseconds longer than a different strike, a deeper, richer sound could be produce; or a completely different sound.

Useful techniques to implement such an improved digital sampling method and synthesis could be comprised of direct sampling of actual acoustic or electronic instrument sound including various articulation events, synthesized sound, mapped articulatable modulation, digital emulation, simulation and digital signal processing algorithms appropriately triggered by defined articulated impact or pressure events as applied by the musician's direct action performing on such an appreciable notational chromatic, percussive or otherwise preferred physical form factor embodiment of the Digital Music Instrument.

The MIDI Impact Translator software algorithms preferably include concepts comprised of dynamic articulation, emulation and user definable triggered simulation of actual acoustic or modern digital instrument sounds. Measured articulation can be mapped to audio samples or wholly synthesized sounds, covering a full gamut of that specific instrument's articulatable dynamic tonal qualities; actual, emulated or simulated. According to preferred embodiments, the DPI outputs MIDI data to a synthesizer or sampler configured to receive MIDI data for production of audio output. Of course, these functions could also be built-in and output could be made via other known means directly to an amplifier, loud-speaker or the like.

According to embodiments of the present invention, the net functionality of a virtual musical instrument simulator may be provided where any instruments articulation capabilities may be defined and applied to a sound produced by an entirely different instrument, which is sampled and stored in the database. In the synthesizer realm of building unique sounds, one can map an instrument's articulate ability.

The invention does not limit how a musician may apply these concepts including any preferred ergonomic form factor to match the physical demands to produce such desired musical effect given the full 3D and Complex Curve form factor possibilities of the Surface Impression Transducer.

The digital musical instrument segments can be designed to provide a full order of magnitude of dynamic musical articulation capability over any existing electronic or acoustic musical instrument. Such described dynamic articulation capability truly represents the pinnacle of musical instrument and electronic controller technologies, a brand new musical instrumental sound database as well as methodologies of artistic performance.

The architecture of the enveloping digital musical instrument segments shown and described herein, provide the skilled person with all this is needed to integrate new concept designs or the enhancements.

Form Factor Design requirements for the Surface Impression Transducer segment could be implemented into any two-dimensional (2D) area surface shape, such as used in the exemplary embodiment example prototype 6" round form factor digital percussion instrument another example. In another example, three-dimensional (3D) surface applications such as 'Stringed Instrument' designs (See FIG. 6) complete with 2D fretboard array of sensors integrating 3D surface protrusion actuated elongated sensor triggering to mimic the raised physical component of 'strings' traversing the fretboard representing the proper feel and physical articulation of the instrument.

3D implementations could include, but are not limited to bumps, extensions, raised lines, protrusions and depressions within the Cartesian coordinates about the 2D sensor surface point, not superficial but expressly utilized to augment the intended articulated tactile feedback and feel emulating the target instruments mechanical user interface transfer of impact or pressure events to the sensor proper. This brand new concept better represents an instruments traditional player feel, or to define entirely new musical player methods.

In summary, the 3D or Complex Curve form factor design (FIG. 7A, 7B) capability potential of the Surface Impression Transducer, Recognition Processor algorithms and Articulation Sampling Method concepts introduce an entirely brand new realm of digital musical instrument controller creation possibilities. The complex curved sensor shape designs using flexible circuit technology opens up endless possibilities never before possible in musical instrument design.

FIG. 7A shows an example of a flexible force sensing resistor and flexible printed circuit technology 'free form' implementation to form to various existing 3D surfaces. FIG. 7B shows an example of the same, but implemented on a fixed design three-dimensional form factor base. By adding the Z-dimension, new and unique articulations can be measured and mapped to create new and unique instruments, or to mirror any existing instrument imaginable.

The skilled person will readily appreciate the application of the Digital Musical Instrument components comprising the improved Surface Impression Transducer, Articulation Recognition Processor formulated into a fully polyphonic digital percussion instrument MIDI controller is an improvement to, and well beyond typical electronic drum pad functionality comprising the unique integrated blend of electronic hardware, software and external computer platform and configuration software. Analog processing circuits, hi-performance on-board computer and real-time operating system software provide full surface polyphonic processing of multiple simultaneous impact or pressure events including real-time computations of additional useful characteristics comprising dynamic sensitivity, resolution, area, event curve timing, true attack and release velocity curves, continuously variable after-touch pressures as well as configurable articulation recognition or various augmentation functions applied to user articulated events as desired. The external computer platform and configuration software approach takes advantage of the availability of ultra hi-performance processors, high resolution display and storage capabilities of desktop, notebook or tablet computers.

This polyphonic digital percussion instrument embodiment of the present invention can be fully software configurable to recognize various impact or pressure events and articulations ultimately formatted into standard MIDI commands transmittable to any MIDI enabled Synthesizer, Digital Recording Sampler, Computer Software VST or existing Drum Brains. The Digital Percussion Instrument application allows for very impressive modulation contouring capabilities by applying various impact interpretation or modulation functions to formulate impact interpretation and define or further contour the resulting emitted modulation variable. The user may select one or more of the available functions to define the characteristics of, or how to interpret, a measurable articulated event, uniquely augmenting the resulting modulation contour value or increment. These functions may be applied in parallel, sequentially layered or linked format for increasingly complex modulation contouring. The variable routing architecture of the functions provided are in effect limitless to how impact or pressure events are interpreted or how you may further contour your resulting articulated modulation and ultimately control sound as never before possible. The end result can be as simple or as complex as your imagination and attached sound generation hardware allows.

In a preferred embodiment, the improved Surface Impression Transducer of sufficient drum stick tip sensor density is coupled to a high performance on-board computer of sufficient power to handle the time critical processing requirements of multiple, microsecond frequency impact responses in regards to meeting MIDI protocol transmission speed, exceeding by 50× the fastest drummer or approximately 1500 beats per minute. Digitally controlled amplifiers implemented for real-time dynamic sensitivity adjustment across the entire surface would allow independent positional area actuation by light hand, finger or various forms of heavy impact mallet or stick implements. Physical impact damping mechanics may be integrated about and enveloping the Surface Impression Transducer proper, comprising, for example, rubber, springs and felt material, resulting in improved sensor performance, user feel, quietness and durability.

Figure 8A:
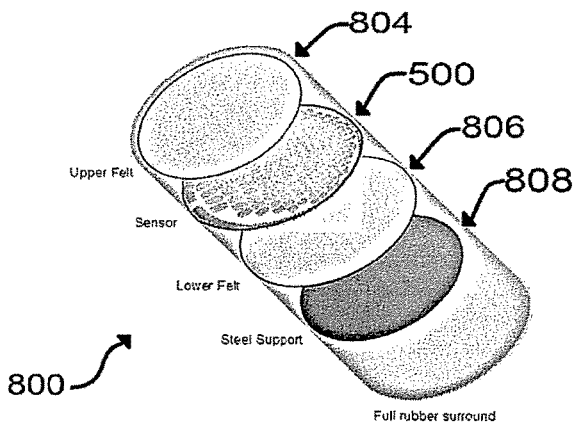
FIGS. 8A and 8B illustrates the sensor assembly damping mechanics according to an embodiment of the invention.
Figure 8B:
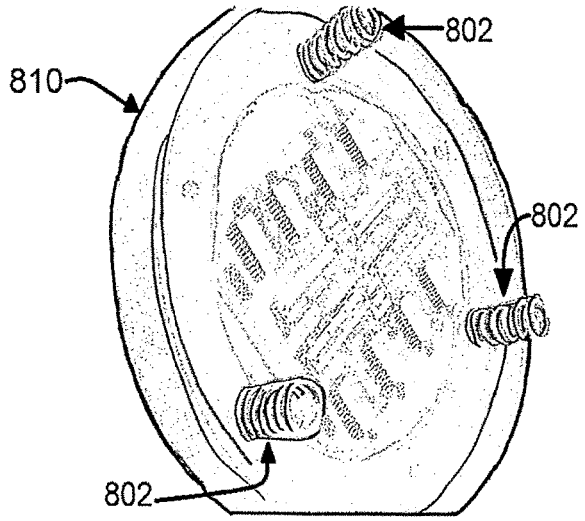

According to an embodiment of present invention, the Digital Percussion Instrument rubber surface enveloping the improved Surface Impression Transducer assembly (FIGS. 8A, 8B) can be spring mounted, providing rough damping mechanics for durability and excellent live user feel. As shown, 3 springs 802 may be positioned at equal distance undernamed the instrument to be connected to a base (not shown). However, any base plate of arbitrary design that accepts and mates to the corresponding surface impression transducer design¥ may be used, with or without dampening. Or other forms of dampening could be used.

The top surface of the instrument 900 OMG consist of a specific engineered durometer rubber material 908 having a thickness providing impact damping for increased sensor durability, acoustic damping for optimal recording studio use as well as excellent stick rebound properties for superb playability. The upper subsurface felt 804 provides additional impact damping characteristics improving overall sensor performance. Lower subsurface felt 806 provides additional shock absorbing properties. Printed circuit standoff from the steel subsurface rigid mechanical support layer 808 provides electrical insulation and surface venting through printed circuit vias as previously described. The mated flexible Mylar/rigid printed circuit configuration 800 including felt and steel support layers are retained by a fitted 'pocket' internal to the molded rubber surround layer 810.

Figure 9:
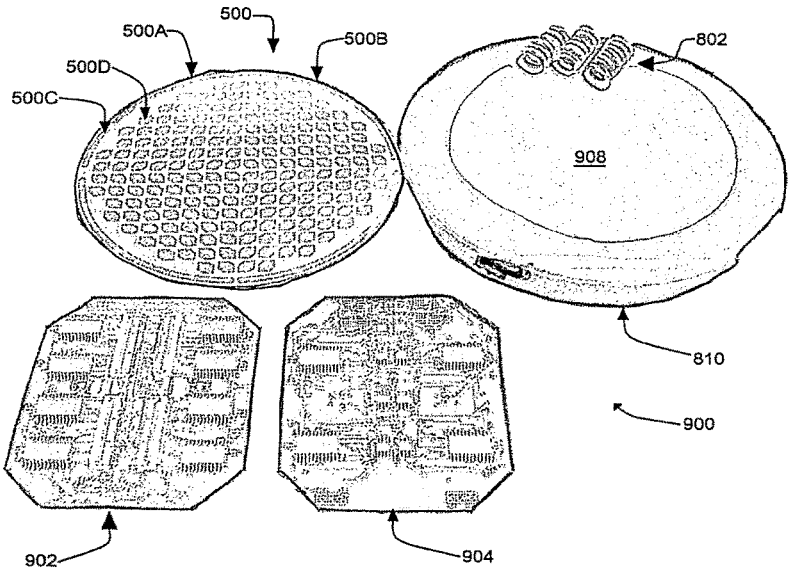
FIG. 9 illustrates components of an exemplary device according to an embodiment of the present invention.
Figure 10A:
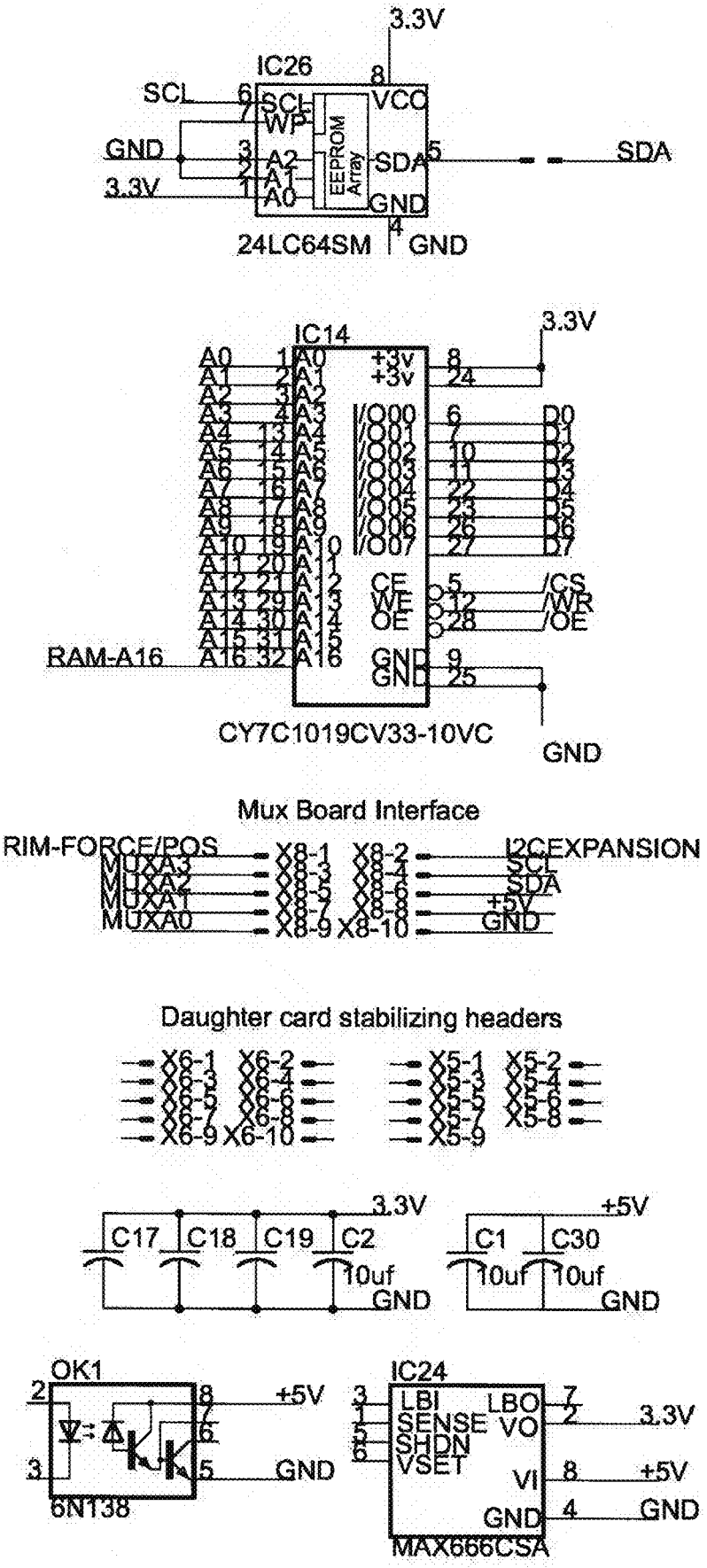
FIGS. 10A and 10B illustrate processor hardware logic of an exemplary device according to an embodiment of the present invention.
Figure 10B:
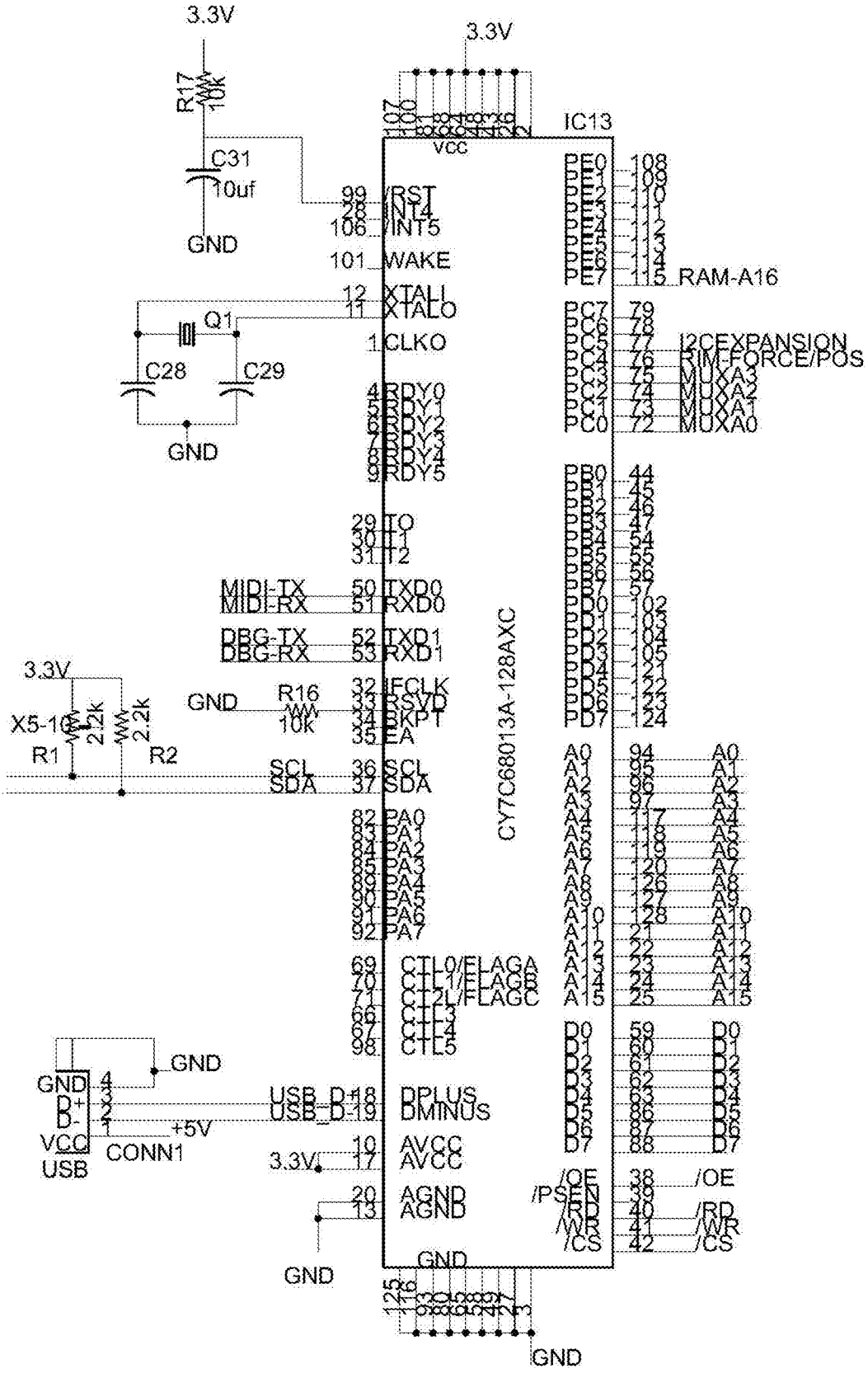
Figure 11A:
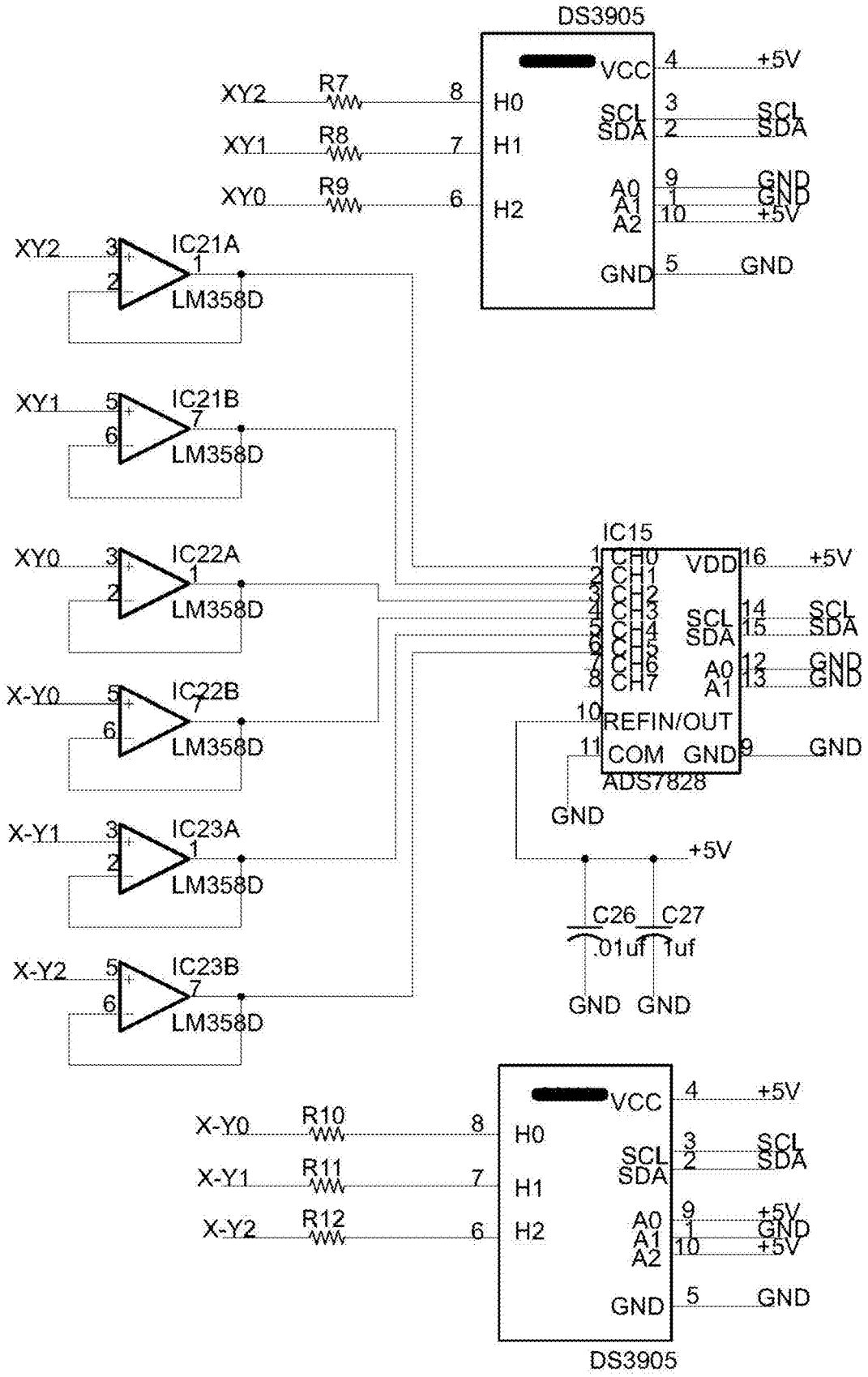
FIGS. 11A-11H illustrate the sensor interface hardware logic of an exemplary device according to an embodiment of the present invention.
Figure 11B:
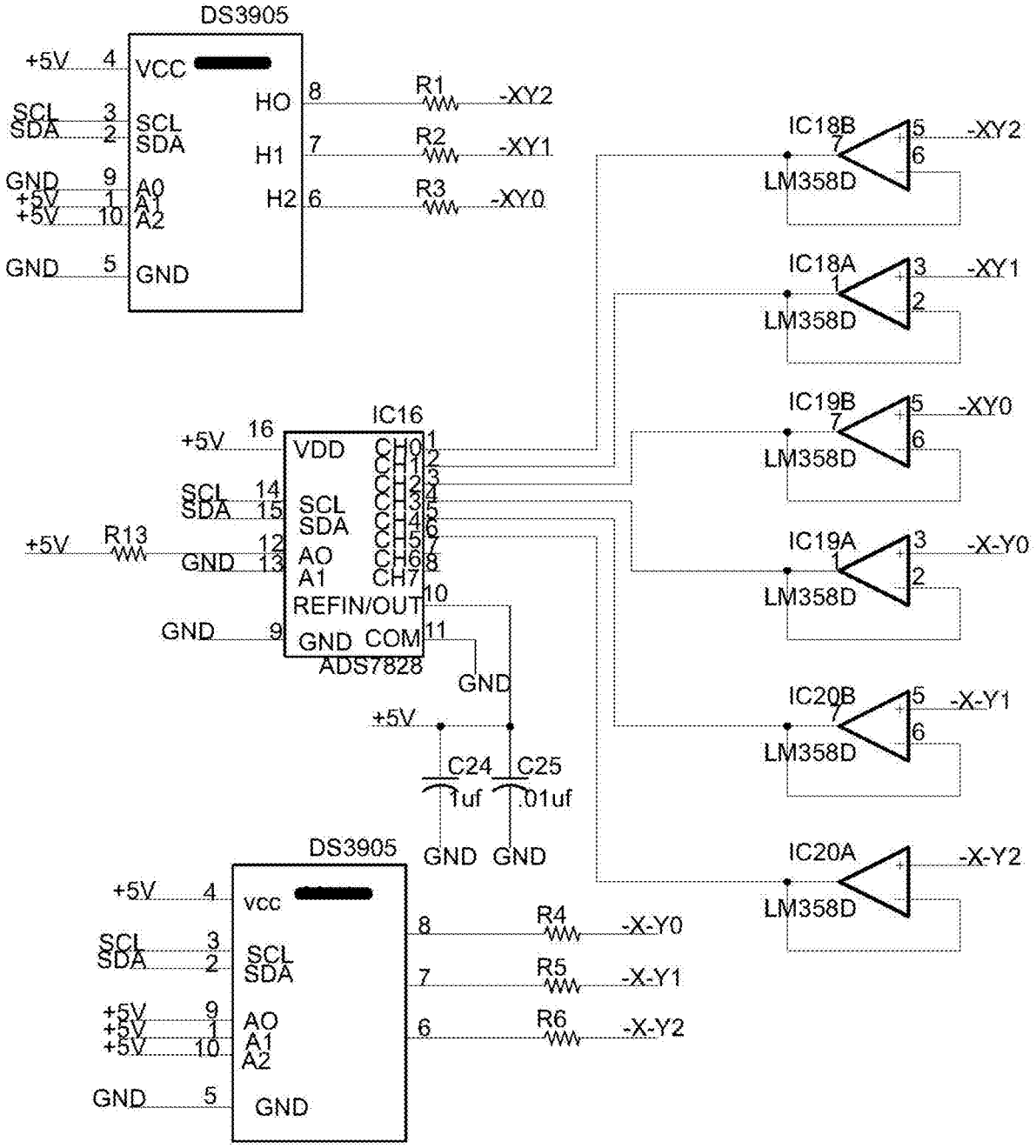
Figure 11C:
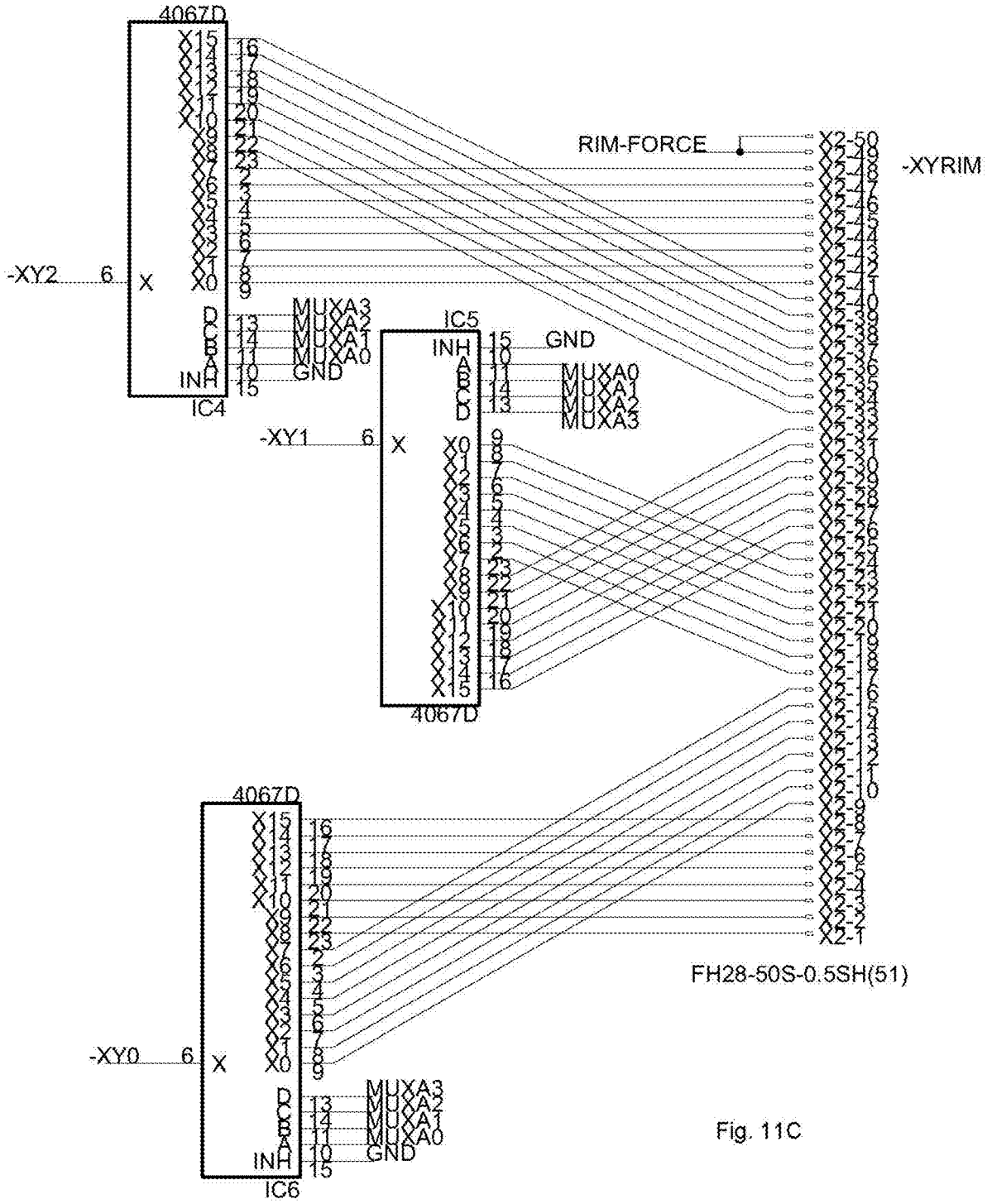
Figure 11D:
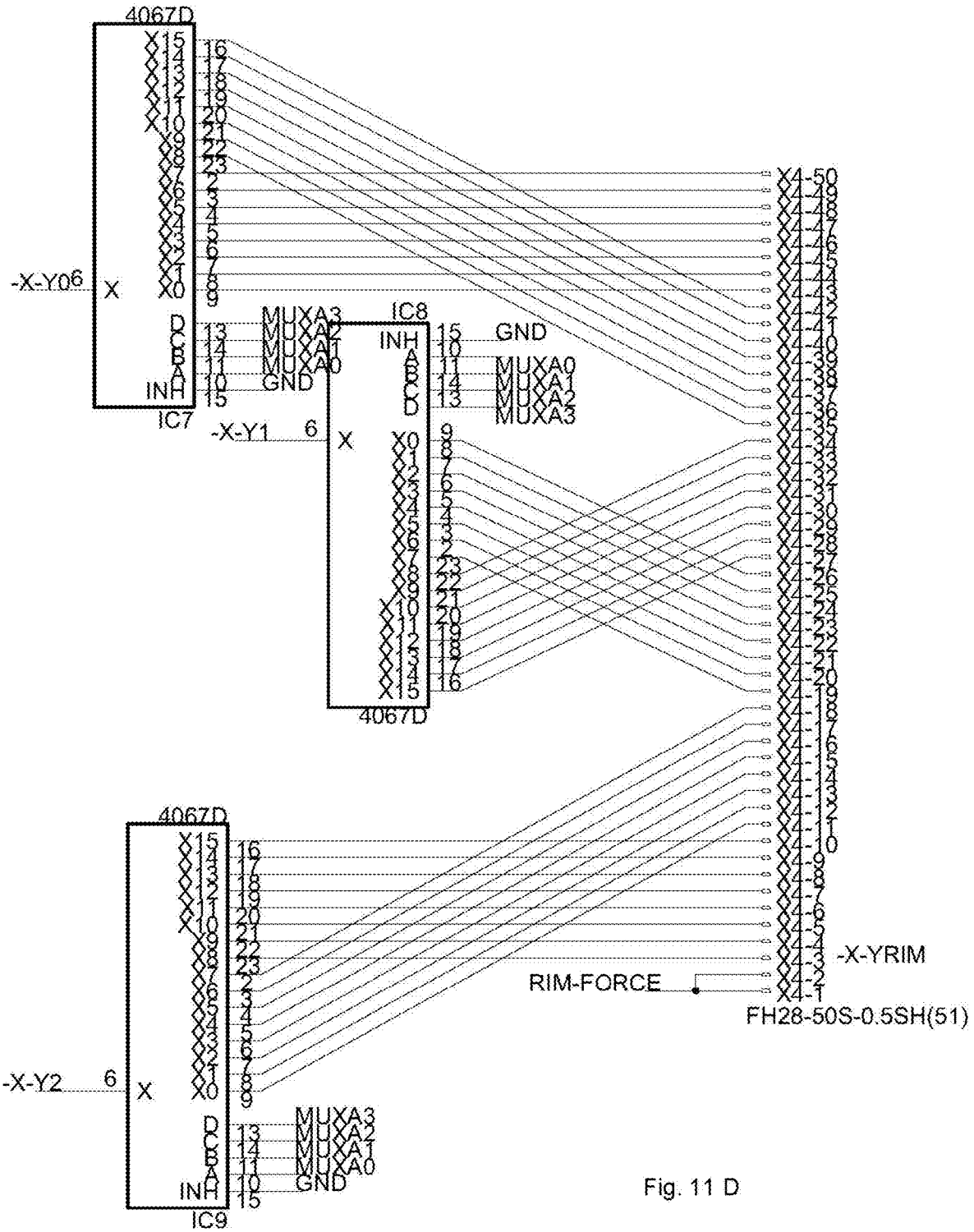
Figure 11E:
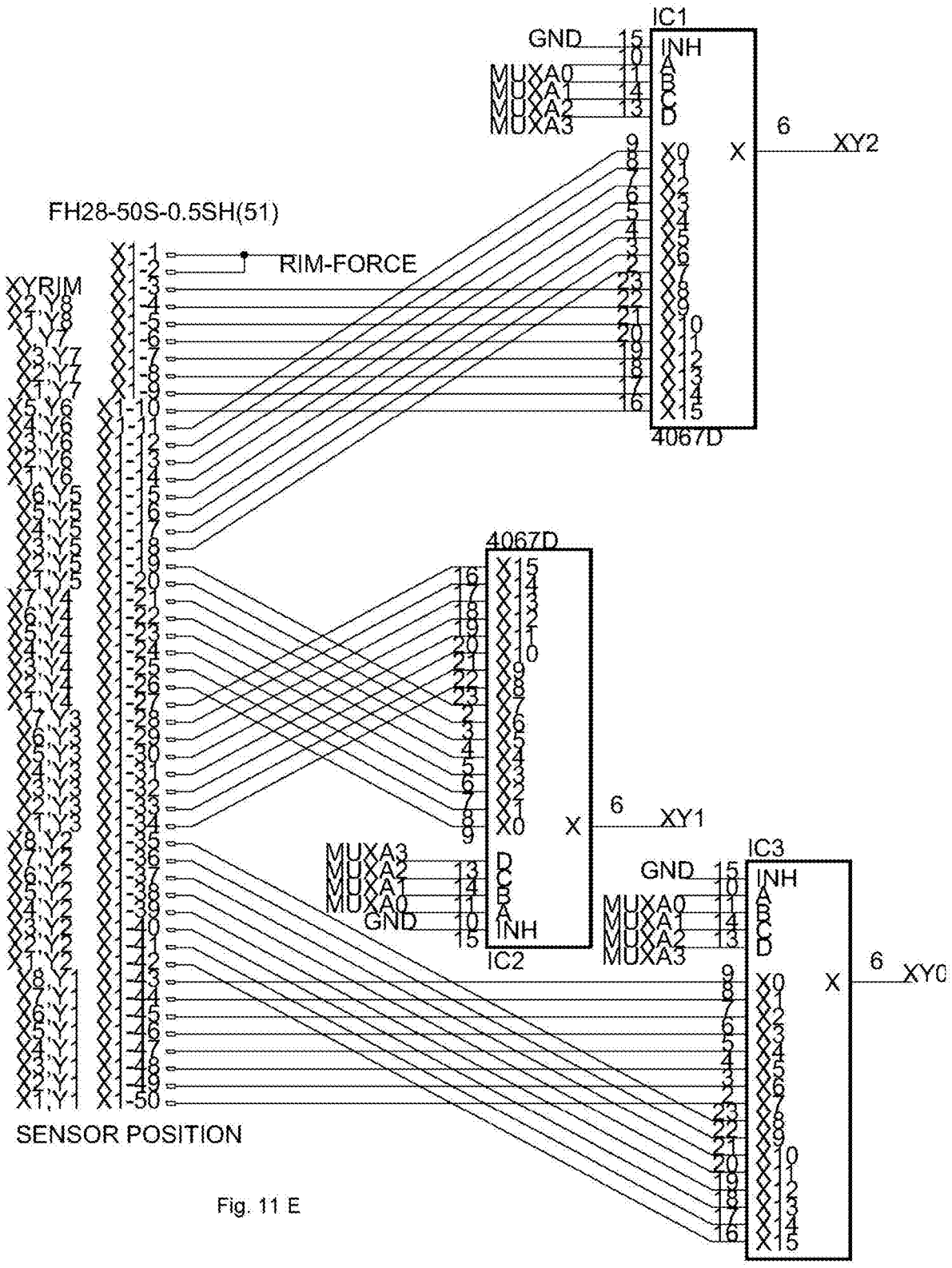
Figure 11F:
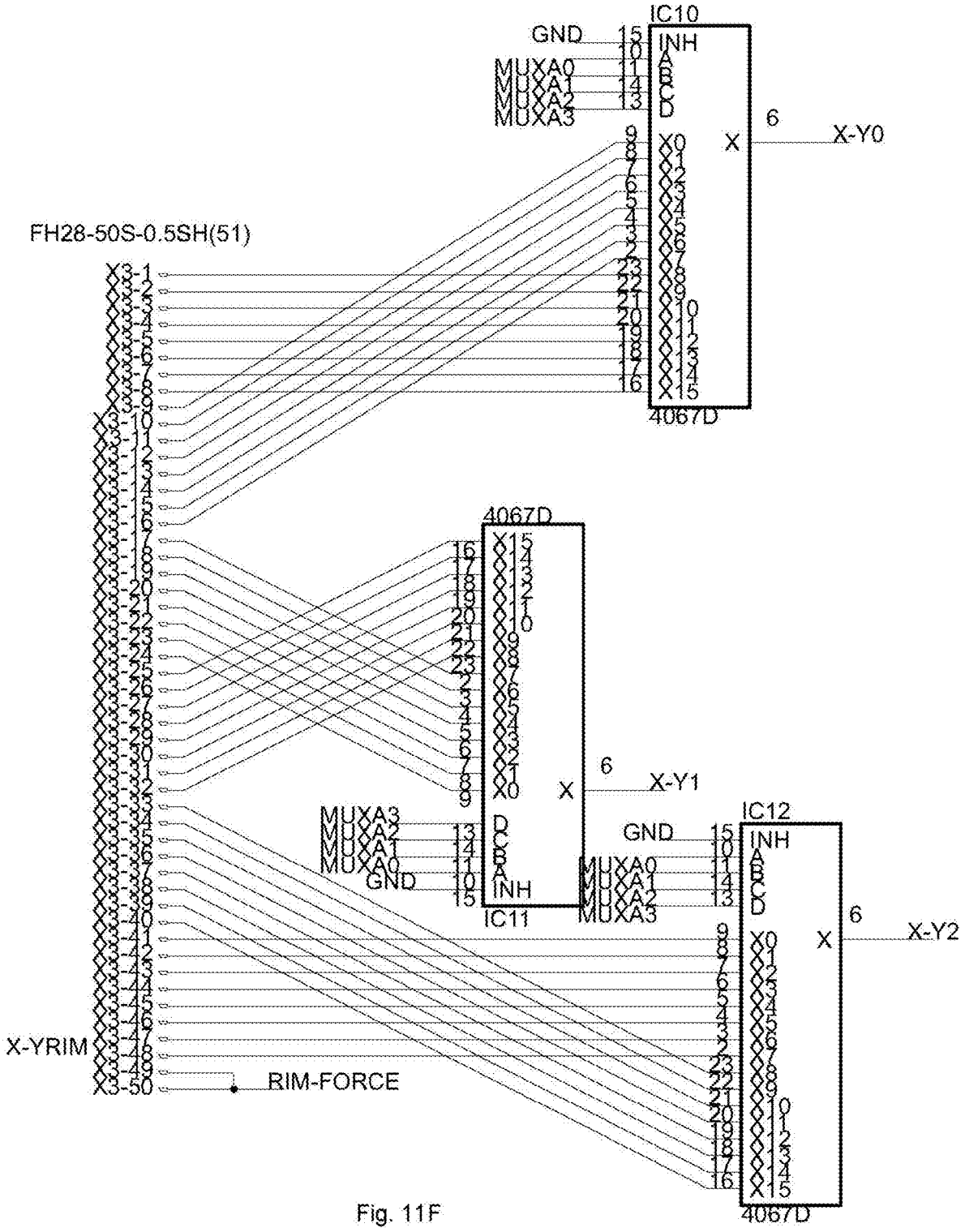
Figure 11G:
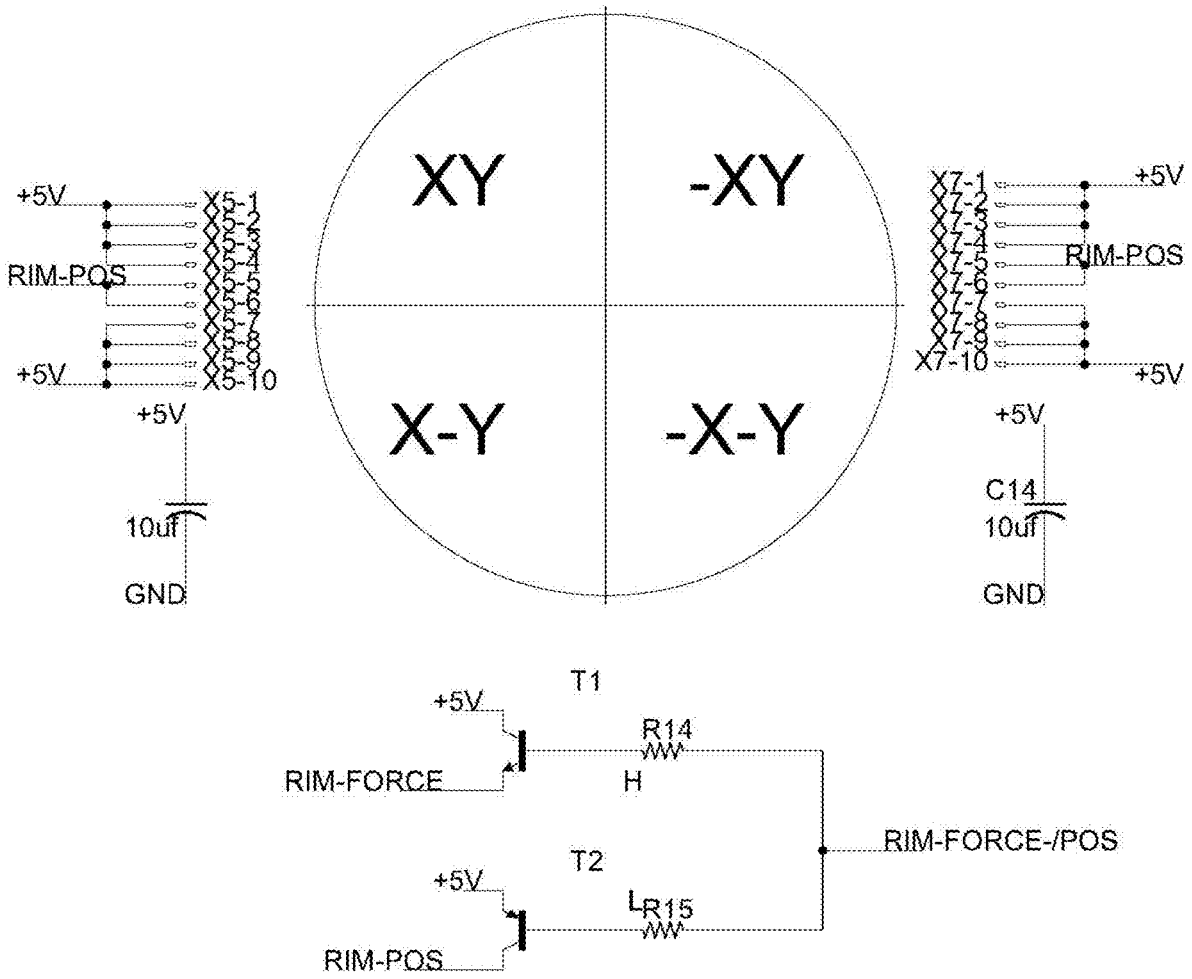
Figure 11H:
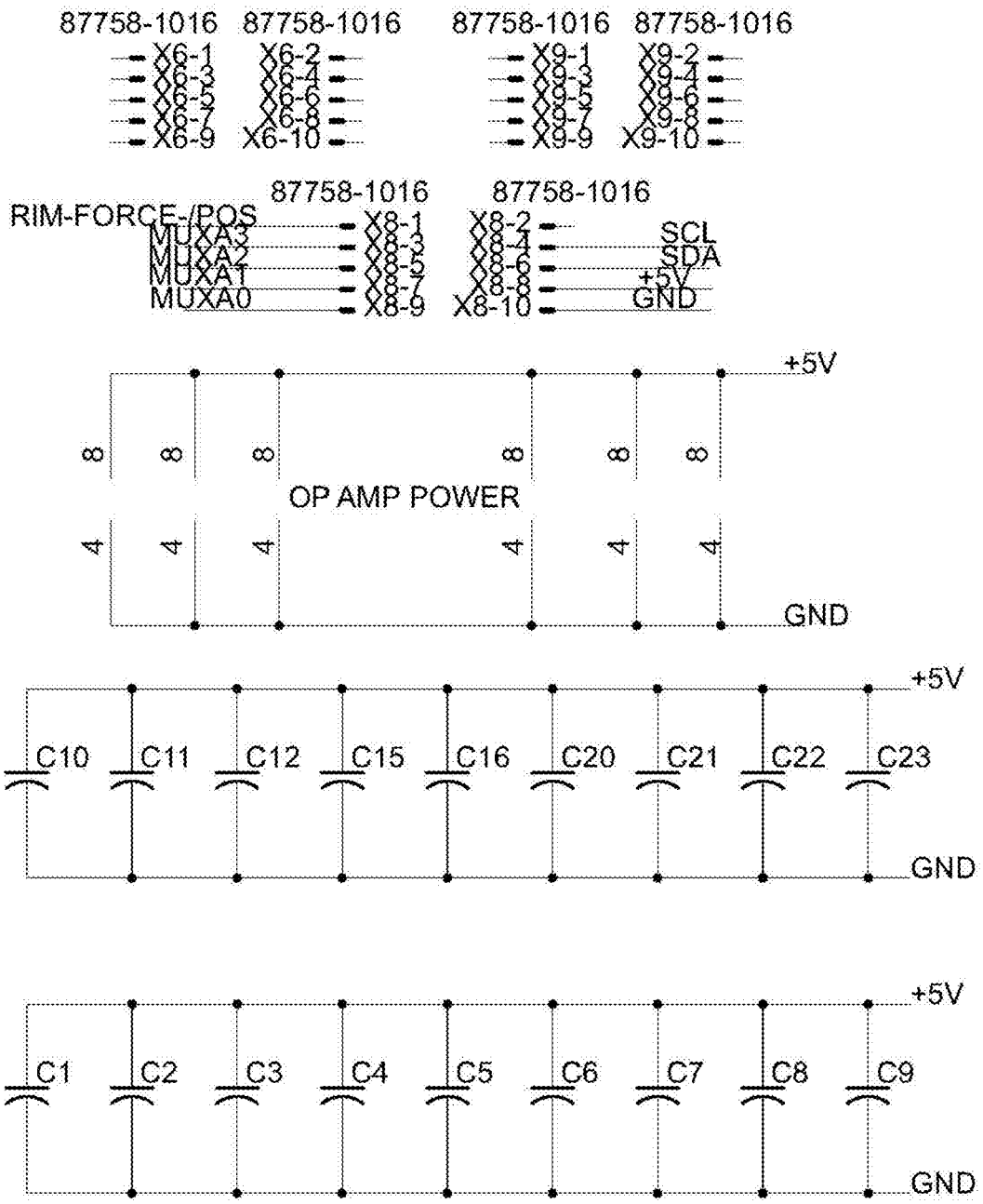

According to one exemplary embodiment, a 6" round form factor prototype features a three board set. Referring to FIG. 9, according to an embodiment of the present invention, a musical instrument 900 may include improved Impression Surface Transducer board 500 comprises a one hundred and eighty-eight~8 mm SAR y, x array core, four~2.75"×~0.225" SARP sensors 510 equally spaced in four quadrants 500A-D encircling the core SAR array, a Multiplexor Data Converter board 902 and a Processor Input/Output board 904. The Sensor taps can be individually, electronically cabled or hard stacked to the Multiplexor board 902, which has a 192:12 analog multiplexor, 12 I-V convertor OP AMP circuits, two 8 input multiplexed Serial ADC's and dual voltage switches for SARP operation. See FIGS. 11A-11H. The Processor board 904 communicates with the Multiplexor board via a 9 wire interface; 2 wire I2C serial port. 4 multiplexor address bits. 1 power control bit for the SAR/P2 sensors. +5 VDC and ground. See FIGS. 10A and 10B. The Processor board may be comprised of a 48 Mhz Cypress FX2LP USB Microcontroller, 128K×8 Static Ram, 1 or 2 64K serial EEPROMs and external I/O consisting of USB, MIDI and RS232 ports. The entire 3 board set 900 is sufficiently powered by and operates within the electrical current supply parameters of typical USB supply specifications, and accordingly, could be powered by a USB power supply.

According to a preferred embodiment of the present invention, integrated within the Digital Percussion Instrument design is an accompanying external MIDI Impact Translator (MIT) software Graphical User Interface (GUI) running on a desktop, notebook or tablet computer that communicates with the Digital Percussion Instrument via USB or other digital protocols.

Figure 12:
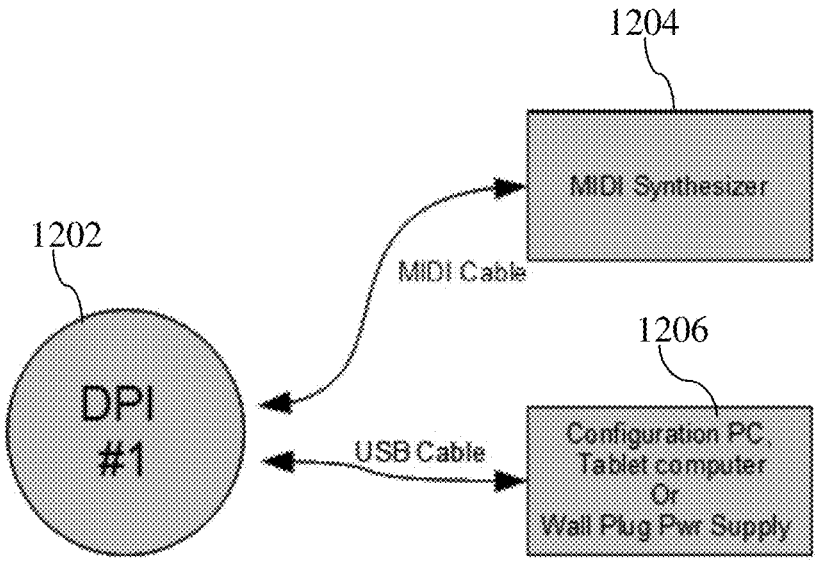
FIG. 12 illustrates general single DPI pad setup cabling according to an embodiment of the present invention.

As shown in FIG. 12, a DPI 1202 is electronically coupled with and MIDI synthesizer to 1204 and a computer 1206 via an MIDI cables and USB repeatedly. The MIT software package can be used by the musician or instrument technician (e.g., drum technician) to partition the playing surface and define what happens when hit. The MIT software architecture preferably allows full configuration of the playing surface, partitioned by Shapes with Impact Events used to define what occurs when you strike the surface within each shape. A typical user scenario operates as such:

Open an MIT virtual Digital Percussion Instrument window to add one or more

Shapes onto the play surface.

Define the Impact Event detection, resulting Modulation and MIDI Action for each Shape.

The simplest configuration for the DPI is a single round Shape that covers the entire play surface. Simply drag & drop or draw one or more Shapes onto the virtual pad surface in individual, layered or linked formats.

More complex configurations are contemplated, such as, for example, multiple Shapes resembling the tuned surface of a Steel Drum.

An Impact Event in this application is the trigger to generate Modulation values by stick control or articulation. Impact Events can be defined within each Shape and may occur by Level, Range or Frequency of impact or pressure Force, Position and/or Area. The resulting Modulation contour value can be incremented by in, out, up, down, left, right, center-to-edge or radial stick movement or articulation in configurable positive, negative, linear, exponential, random or chromatic steps. Multiple parallel or layered sequential Impact Event Modulation contouring may be defined per Shape using any of these 20 characteristic functions to define impact interpretation or further induce modulation contouring. Each Impact Event and resulting Modulation may be mapped to an appropriate MIDI Action. For the previous complex Shape example given, map to the sounds, tunings and modulations of a Multi-sampled Steel Drum.

According to embodiment of the invention, the perimeter edge or rim of the surface may include multi-segmented sensors for implementing Tympani, Roto-tom or other modulation or voicings such as Rim Shot, Hi-Hat, Crash/Ride cymbal, bell or choke for example possibilities. Four equally spaced perimeter sensors could be provided to individually detect Force and Position about the length of the each sensor. The RIM sensors in the embodiment are preferably fixed in shape and employ a subset of the impact and modulation function. For example, a ride cymbal could be assigned to one half of a rim sensor and crash cymbal to the other half. Positional and Force information within each sensor half may be available for additional modulation effect. For example a closed Hi-Hat sound could be gradually opened as the impact position increases as desired by the performing musician. The four sensors could operate independently from each other, or in unison.

Any configuration changes on the MIT Virtual Digital Percussion Instrument surface can be simultaneously reflected on the selected actual Digital Percussion Instrument unit(s) and immediately available for trial.

Figure 14:
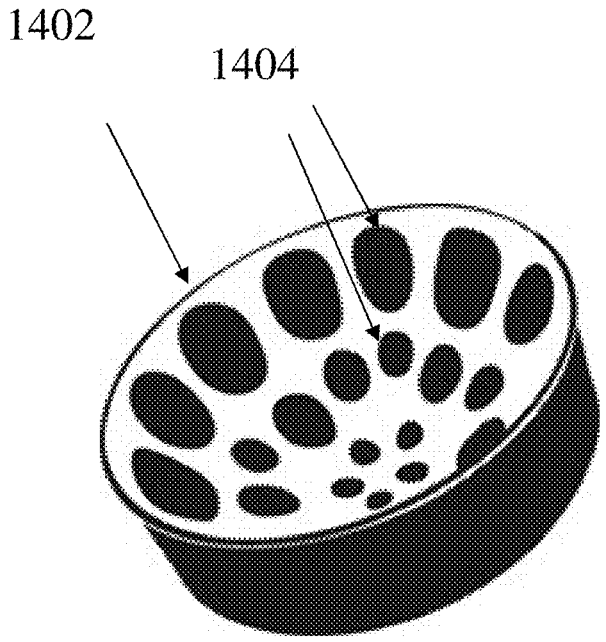
FIG. 14 is an exaggerated example of a three-dimensional molded rubber replacement surface for a DPI according to an embodiment of the present invention.

FIG. 14 illustrates an exaggerated example of a three-dimensional molded rubber replaceable surface. This one example is for a Steel Pan Drum emulation, but the concept can be applied to nearly any type of instrument. Areas of a different color or darkness 1404 are provided on an overlay 1402 on top of the surface transducer of the present invention, where if struck, will trigger (via MIDI) specific digitally sampled Steel Pan drum notes. The skilled person will readily understand that the corresponding areas of the surface impression transducer can be mapped to steel drum sounds, and varied within those areas to provide a full range of articulation. The skilled person will understand than nearly any overlay could be provide to simulate the look and feel of any instruments, and mapping of the corresponding areas of the surface impression transducer can provide desired articulation of that instrument.

Figure 13:
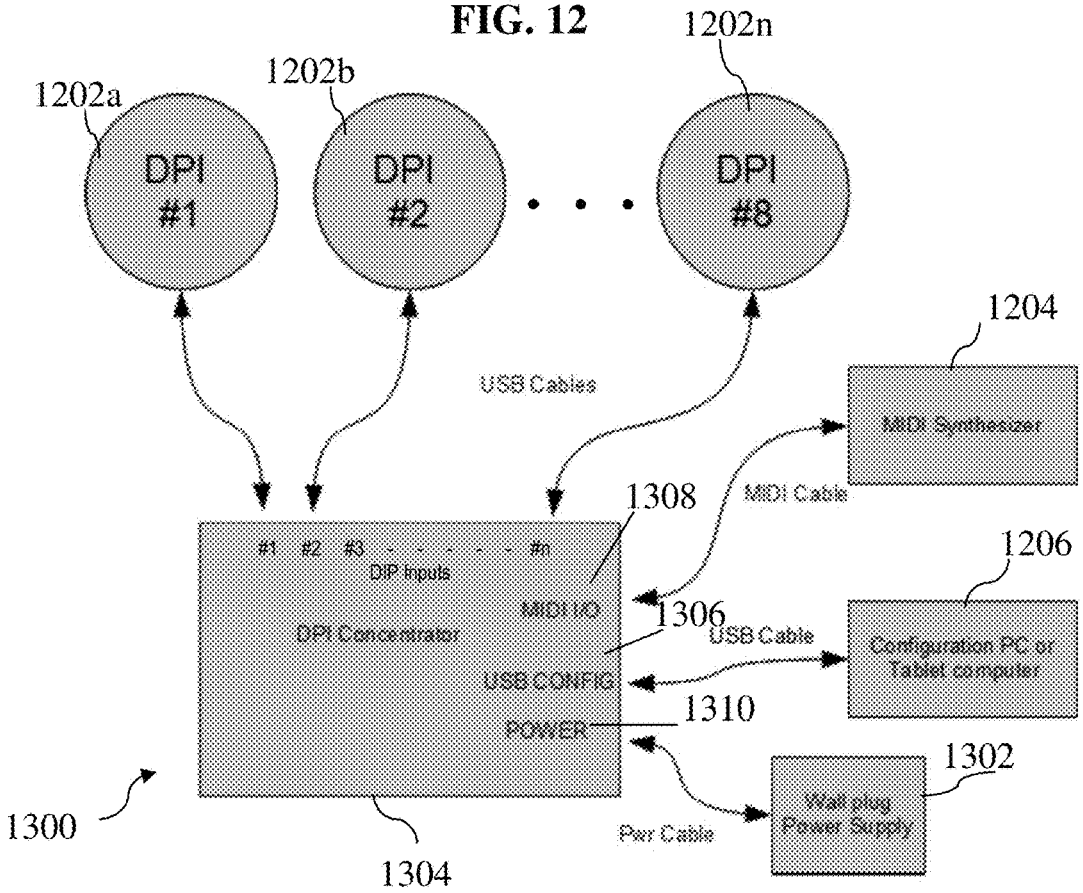
FIG. 13 illustrates a multiple DPI pad setup using the DPI concentrator according to an embodiment of the present invention.

Referring to FIG. 13, the Digital Percussion Instrument (DPI) application is preferably elegantly expandable into a multi-pad setup 1300 for use in Drum Kit form. This can be achieved by linking one or more pads together via a DPI Concentrator accessory 1304, which includes a plurality of DPI inputs with enhanced USB form factor communication protocol and power requirements.

A dedicated connection 1306 (e.g., USB, Firewire®, RS232 etc.) can be provided to connect to a PC, Tablet, or other devices running the MIT configuration software.

MIDI In/Out and Thru ports 1308 and power socket 1310 for external wall plug type power supply can meet the power requirement of multiple DPI's for example. This can be familiar to the connection scheme used by typical multi Drum Pad/Drum Brain Kit setups, except a USB cable is used to connect each pad rather than ¼" phono plug cables.

The DPI Concentrator 1304 and all connected pads 1202*a-n* can be played and configured using the single MIDI cable to the sound generation hardware and single USB cable to a configuration PC, notebook or tablet running the MIT software.

Single DPI Cabling is illustrated in FIG. 12 according to an embodiment of the present invention.

A software utility can be included to identify and auto-program each pad 1202 in the drum kit by surface impact so the pads 1202 can be setup in random order and quickly matched to the programmed kit configuration. A single DPI configuration can be broadcast into one or more selected DPI's at a time if desired.

Various synthesizers apply MIDI commands in various ways. There is some consensus but likely the command string will vary from one synth to another. That said either a single pad or multi pad setup could emit USB or MIDI to a PC or MIDI synthesizer to create audio or, the DPI could have a built-in synthesizer itself and emit an audio signal to an amplifier.

Figure 15:
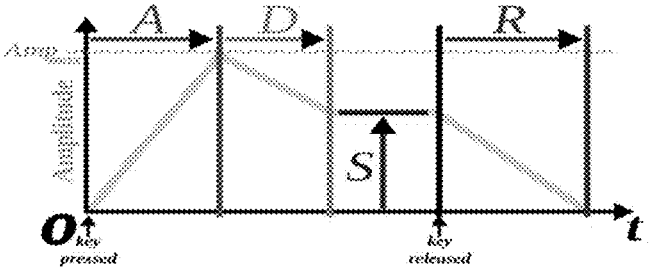
FIG. 15 is an illustration of the Attack/Decay/Sustain/Release (ADSR) sound envelope.

A key feature of the DPI is full dynamic articulation of the Attack/Decay/Sustain/Release (ADSR) sound envelope. See FIG. 15 for an illustration of the ADSR sound envelope. This allows articulation of sound similar to an acoustic instrument. It is believed that no one else has done this electronically before the present invention. An electronic keyboard may therefore be provided with static Attack/Release velocity and dynamic Sustain being the length of key press until release and dynamic key pressure or After-touch modulation during sustain.

Accordingly, the present invention provides electronic control such that, proved a base frequency/harmonic (sound), the ability to modulate its ADSR provides full control of the output of the inventive instrument, in real-time.

The MIT software may preferably be enhanced by various configuration, player information and performance utilities comprising:

- Timing analyzer
- Metronome
- Notational, Rhythmic Training and Stick Control exercise analysis
- Real-Time 3D mesh surface impact display
- Pad ID by Impact with Auto Kit configuration
- Auto load Software updates
- Autonomous Pad and Concentrator MIDI data flow filters
- Router app to allow access to any MIDI port throughout a Kit
- Data backup and restore
- Offline configuration
- Play synchronized control of MIDI DMX Stage Lighting and ILDA LASER light projectors According to embodiments of the present invention, a fully surface programmable, polyphonic Digital Percussion Instrument application is provided that outperforms, solves and improves upon limitations of all existing Piezo, FSR or DSP based electronic drum pad designs.

The following is a non-limiting list of improvements that can be achieved through the embodiments of the present invention:

Multi-damped sensor surface for improved performance, feel and durability

Rubber 'Gladstone' practice pad like surface provides excellent stick rebound, low audible impact suitable for studio session work Favorable stick response. ZERO pad-to-pad crosstalk. NO false triggering Fully polyphonic surface impact/pressure articulation to MIDI modulation translation Programmable dynamic sensitivity for play by Hand or Stick User friendly configuration software using desktop, notebook or tablet computers Simple user configuration—Define Shape, Impact Event, Modulation, MIDI action.

Autonomous operation after configuration.

Print durable pad surface configuration overlay for practice or performance

Comprises external player information and performance utilities

Single USB Configuration/Power cable. MIDI Interface port

Fully powered by USB cable via computer or Wall Plug (phone charger) type

Auto load software updates and performance enhancements

DPI Concentrator simplifies drum kit setup and configuration

Thus, a number of preferred embodiments have been fully described above with reference to the drawing figures. Although the invention has been described based upon these preferred embodiments, it would be apparent to those of skill in the art that certain modifications, variations, and alternative constructions could be made to the described embodiments within the spirit and scope of the invention.

I claim:

1. A digital musical instrument comprising:

a sensor matrix of at least four rows and four columns of sensors having an upper surface and an electronic circuit for outputting an electrical signal representative of an impact spanning two or more sensors of said matrix to the upper surface; and an articulation recognition processor coupled with said sensor matrix to receive said electrical signal output thereby and configured to process said electrical signal to determine an associated sound to be output based on said electrical signal, and to output a signal representing the determined sound;

wherein the articulation recognition processor is configure to determine the associated sound based on a measured continuously variable location of the impact and a continuously variable force measurements of the impact spanning said two or more sensors in said matrix in real-time, over a period of time.

2. The digital musical instrument recited in claim 1, wherein the sensor matrix comprises:

a flexible overlay substrate with an applied resistive print that electrically shorts against an opposed similarly shaped printed circuit when impacted; and sampling circuitry coupled with said printed circuit for sampling an electrical output of an impact event overtime and for generating said electrical signal output representative of said impact event.

3. The digital musical instrument recited in claim 2, wherein the sensor matrix includes an enclosed spacer between said flexible overlay substrate and said printed circuit, wherein one or more air gaps through PCB holes allow air to flow to and from a space between said overlay substrate and said printed circuit during an impact event.

4. The digital musical instrument recited in claim 2, wherein the sensor matrix comprises a matrix of sensors 5×5 or greater.

5. The digital musical instrument recited in claim 2, further including a base to which said sensor matrix is secured by a dampened connection.

6. The digital musical instrument recited in claim 2, wherein said sensor matrix is engineered in a round or rectangular shape.

7. The digital music instrument recited in claim 1, wherein said articulation recognition processor is further configured to determine the associated sound to be outputted based on area of the impact spanning two or more sensors of said matrix and shape of the impact, said shape being a different measurement than the measurement of force.

8. The digital music instrument recited in claim 1, wherein said processor is coupled with a memory storing a plurality of sounds, and said processor is configured to select one or more of said stored sounds to output based on an analysis of the impact.

9. The digital music instrument recited in claim 1, wherein said articulation recognition processor is further configured to determine at least one of a frequency range, tone, volume and duration of the associated sound to be outputted based on one or more of location of the impact, area of the impact, shape of the impact, force of the impact, recurring rate of the impact, physical ADSR envelope tracking, direction of the impact, duration of the impact, and number of impacts.

10. The digital music instrument recited in claim 7, wherein said articulation recognition processor is further configured to determine at least one of a frequency range, tone, volume and duration of the associated sound to be outputted based on one or more of location of the impact, area of the impact, shape of the impact, force of the impact, recurring rate of the impact, physical ADSR envelope tracking, direction of the impact, duration of the impact, and number of impacts.

11. The digital music instrument recited in claim 9, wherein said digital musical instrument is a three dimensional instrument and said location includes location in an x, y and/or z directions.

12. The digital music instrument recited in claim 1, further comprising multiple sensor matrices each coupled with said articulation recognition processor.

13. A digital instrument kit, comprising:

a plurality of digital music instruments according to claim 1;

a digital music instrument concentrator having a plurality of inputs for coupling with said plurality of digital music instruments to receive the signal output from each digital music instrument, and for coupling with a computer or synthesizer, to provide the signals received from the plurality of digital music instruments to said computer or synthesizer, said concentrator also configured to provide power to said plurality of digital music instruments.

14. The digital music instrument recited in claim 1, wherein said signal output by said processor is an MIDI signal.

15. The digital music instrument recited in claim 9, wherein said signal output by said processor is an MIDI signal.

16. The digital instrument kit recited in claim 13, wherein said signal output by each of said plurality of digital music instruments to said digital music instrument concentrator is an MIDI signal.

17. The digital music instrument according to claim 9, further configured to modulate a sound by dynamically adjusting the sounds ADSR.

18. The digital music instrument recited in claim 7, where impact adjacency is used to determine impacts spanning two or more individual adjacent sensors of said matrix.

19. The digital music instrument recited in claim 9, wherein said digital musical instrument has a virtual surface shape based configuration that can define multiple, virtual shapes on the transducer surface.

* * * * *